US010103459B2

(12) United States Patent
Chen

(10) Patent No.: US 10,103,459 B2
(45) Date of Patent: Oct. 16, 2018

(54) CONNECTOR FOR COAXIAL CABLE

(71) Applicant: EZCONN CORPORATION, Taipei (TW)

(72) Inventor: Han-Chung Chen, Taipei (TW)

(73) Assignee: EZCONN CORPORATION, Taipei (TW)

( * ) Notice: Subject to any disclaimer, the term of this patent is extended or adjusted under 35 U.S.C. 154(b) by 65 days.

(21) Appl. No.: 15/458,045

(22) Filed: Mar. 14, 2017

(65) Prior Publication Data

US 2017/0279206 A1 Sep. 28, 2017

(30) Foreign Application Priority Data

Mar. 23, 2016 (TW) ..... 105204063 U

(51) Int. Cl.
*H01R 9/05* (2006.01)
*H01R 13/622* (2006.01)

(52) U.S. Cl.
CPC ..... *H01R 9/0521* (2013.01); *H01R 13/622* (2013.01)

(58) Field of Classification Search
CPC ..... H01R 17/12; H01R 9/0521; H01R 103/00
USPC ..... 439/578, 584, 583
See application file for complete search history.

(56) References Cited

U.S. PATENT DOCUMENTS 8,157,589 B2 * 4/2012 Krenceski ..... H01R 9/0524 439/578
9,859,631 B2 * 1/2018 Burris ..... H01R 13/622
2015/0024627 A1 * 1/2015 Wei ..... H01R 24/40 439/583
2017/0324193 A1 * 11/2017 Watkins ..... H01R 13/6581
2018/0054017 A1 * 2/2018 Watkins ..... H01R 13/502

* cited by examiner

*Primary Examiner* — Phuong Chi T Nguyen
(74) *Attorney, Agent, or Firm* — Min-Lee Teng; Litron Patent & Trademark Office

(57) ABSTRACT

A connector for a coaxial cable is configured to be mounted to a first threaded surface of a connecting head of an electronic device. The connector includes: a nut configured to be mounted to the first threaded surface; an inner sleeve coaxially arranged with the nut, wherein the inner sleeve has a second threaded surface configured to be mounted to the coaxial cable; and an outer sleeve coaxially arranged with the nut and sleeved over the inner sleeve, wherein the inner sleeve has a first rear-extension portion in an inner space in the outer sleeve, wherein an annular space is between the first rear-extension portion and the outer sleeve and has an axial length smaller than a distance between the inner sleeve and a rear end of the inner space.

20 Claims, 23 Drawing Sheets

CONNECTOR FOR COAXIAL CABLE

BACKGROUND OF THE DISCLOSURE

Field of the Disclosure

The present disclosure relates to a connector for a coaxial cable, and more particularly to a heat-resistance or fire-resistance connector for a coaxial cable, wherein the connector has good electrical conductivity and bonding strength.

Brief Description of the Related Art

Currently, a coaxial cable are generally used for a feeding wire and connecting wire of a wireless-communication device, broadcasting device, television, satellite radar, microwave device or other related electronic device. The coaxial cable is generally installed in a building and thus fire protection is required. A conventional coaxial cable is not required for fire protection, but with improvement of living standards, various electronic devices, wires or cables arranged in the building are urgently required with a function of fire resistance for extending working hours of various communication and alarm equipment to reduce a personnel casualty rate in a specific level. However, the coaxial cable having a function of fire resistance is provided with an outermost plastic coating that is very hard and not easy to stretch due to its requirement to fire resistance. Thus, when it is mounted to a connector for a coaxial cable, it is difficult for an operator to insert the coaxial cable into the connector and poor electrical connection and insufficient bonding strength often occurs due to imprecise assembly between the coaxial cable and the connector.

SUMMARY OF THE DISCLOSURE

The present disclosure provides a connector for a coaxial cable, configured to be mounted to a first threaded surface of a connecting head of an electronic device. The connector includes: a nut configured to be mounted to the first threaded surface; an inner sleeve coaxially arranged with the nut, wherein the inner sleeve has a second threaded surface configured to be mounted to the coaxial cable; and an outer sleeve coaxially arranged with the nut and sleeved over the inner sleeve, wherein the inner sleeve has a first rear-extension portion in an inner space in the outer sleeve, wherein an annular space is between the first rear-extension portion and the outer sleeve and has an axial length smaller than a distance between the inner sleeve and a rear end of the inner space.

The present disclosure provides a connector for a coaxial cable, configured to be mounted to a first threaded surface of a connecting head of an electronic device. The connector includes: a nut configured to be mounted to the first threaded surface; an inner sleeve coaxially arranged with the nut, wherein the inner sleeve has a second threaded surface configured to be mounted to the coaxial cable, wherein the second threaded surface is on an inner surface of a cylindrical wall of the inner sleeve; and an outer sleeve coaxially arranged with the nut and sleeved over the inner sleeve, wherein the inner sleeve has a first rear-extension portion in an inner space in the outer sleeve, wherein a first annular space is between the first rear-extension portion and the outer sleeve.

The present disclosure provides a guide element configured for guiding a coaxial cable to pass through an inner sleeve of a connector. The guide element has a cylinder and a flange radially protruding from said cylinder, wherein the cylinder has a front portion configured to pass into the inner sleeve, wherein the cylinder has a first diameter at a front side thereof smaller than a second diameter of the cylinder at a rear side thereof. A first hole in the cylinder extends in an axis of the cylinder. The flange is arranged at a rear end of the cylinder. When the guide element is mounted to the inner sleeve, the flange contacts a rear end of the inner sleeve and has an outer diameter greater than an inner diameter of the inner sleeve. When the guide element passes through the inner sleeve, the flange is deformed to pass through the inner sleeve from the rear end thereof to a front end thereof such that the guide element is detached from the connector.

These, as well as other components, steps, features, benefits, and advantages of the present disclosure, will now become clear from a review of the following detailed description of illustrative embodiments, the accompanying drawings, and the claims.

BRIEF DESCRIPTION OF THE DRAWINGS

The drawings disclose illustrative embodiments of the present disclosure. They do not set forth all embodiments. Other embodiments may be used in addition or instead. Details that may be apparent or unnecessary may be omitted to save space or for more effective illustration. Conversely, some embodiments may be practiced without all of the details that are disclosed. When the same reference number or reference indicator appears in different drawings, it may refer to the same or like components or steps.

Aspects of the disclosure may be more fully understood from the following description when read together with the accompanying drawings, which are to be regarded as illustrative in nature, and not as limiting. The drawings are not necessarily to scale, emphasis instead being placed on the principles of the disclosure. In the drawings.

Figure 1:
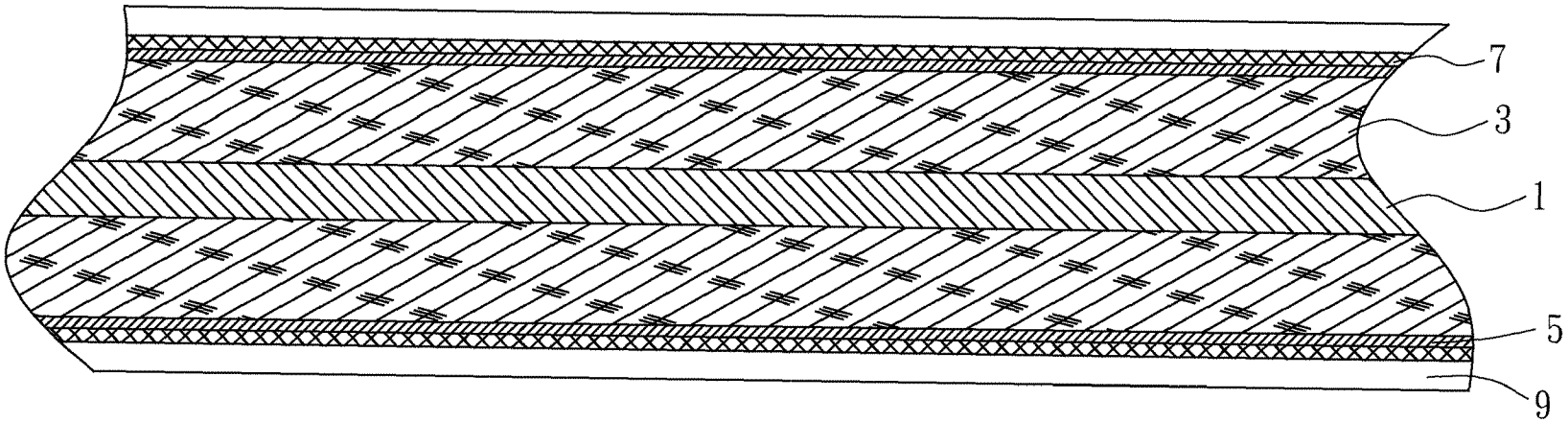
FIG. 1 is a cross-sectional view showing a coaxial cable in accordance with an embodiment of the present application.

While certain embodiments are depicted in the drawings, one skilled in the art will appreciate that the embodiments depicted are illustrative and that variations of those shown, as well as other embodiments described herein, may be envisioned and practiced within the scope of the present disclosure.

DETAILED DESCRIPTION OF THE INVENTION

Illustrative embodiments are now described. Other embodiments may be used in addition or instead. Details that may be apparent or unnecessary may be omitted to save space or for a more effective presentation. Conversely, some embodiments may be practiced without all of the details that are disclosed. When the same reference number or reference indicator appears in different drawings, it may refer to the same or like components or steps.

FIG. 1 is a cross-sectional view showing a coaxial cable in accordance with an embodiment of the present application. Referring to FIG. 1, a coaxial cable includes a metal wire 1, an insulating layer 3 enclosing the metal wire 1, a metal film 5 enclosing the insulating layer 3, a braided metal layer 7 enclosing the metal film 5, and a plastic jacket 9 enclosing the braided metal layer 7. The metal wire 1 may be made of copper, iron, silver, nickel, tin, gold, a copper-gold alloy, a copper-tin alloy, a copper-nickel alloy, a conductive polymer or a non-metallic conductor. The metal film 5 may be made of an aluminum-containing film, copper-containing film, or conductive film, such as aluminum or copper foil, wherein the metal film 5 has an electrical shielding effect to reduce electrical interference. The braided metal layer 7 may be made of two, three or four layers of braided metal, such as aluminum, an aluminum alloy, copper or a copper alloy. The plastic jacket 9 may be made of a fire-resistance or heat-resistance material, such as polyvinylchloride (PVC), polyethylene (PE), cross-linked PE or a low-smoke free-halogen (LSFH) material.

The application provides multiple embodiments having specific technical features that can be combined into other derivatives, and these embodiments are mentioned as below:

First Embodiment

Figure 2A:
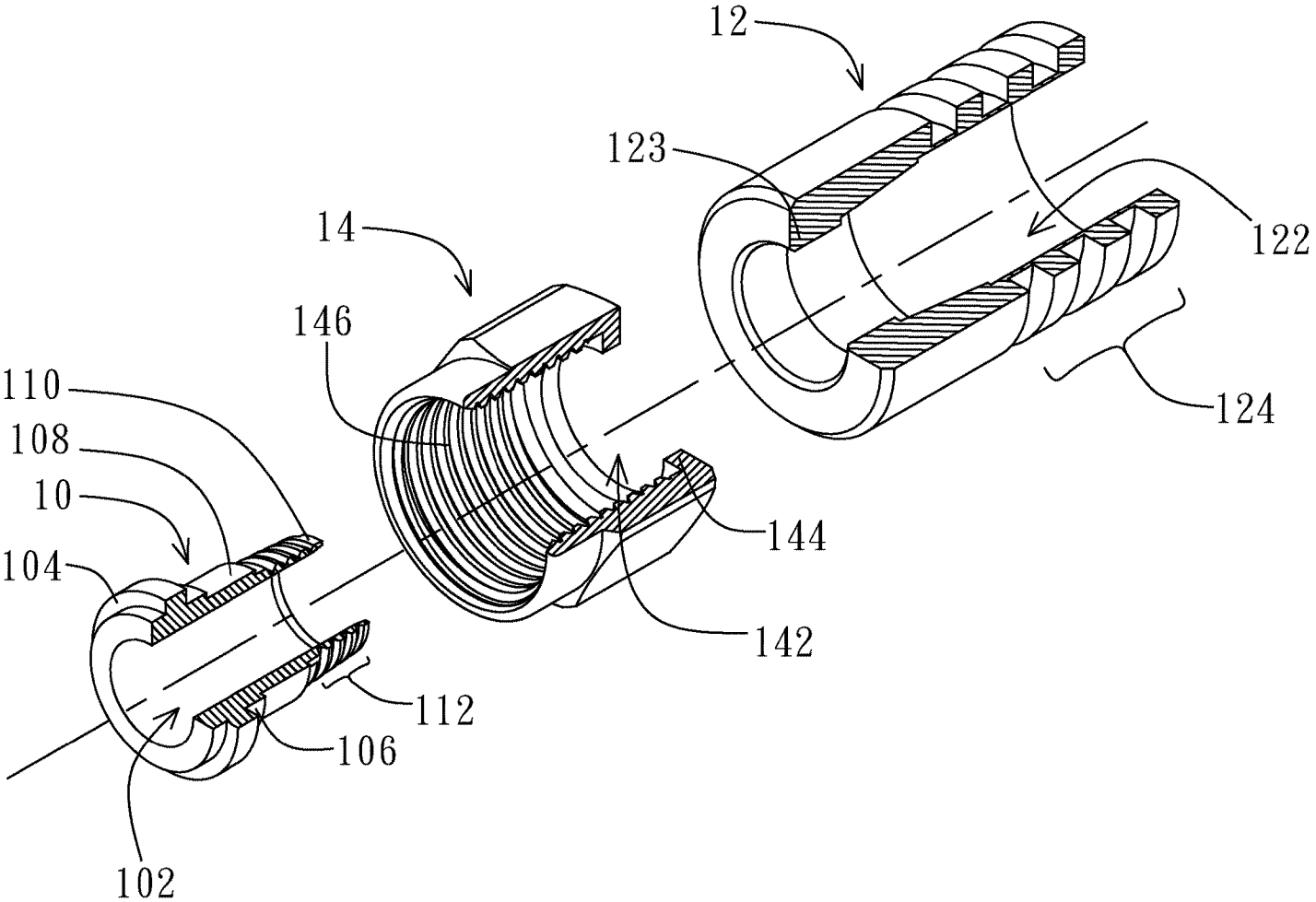
FIG. 2*a* is a cross-sectional perspective view showing multiple elements exploded from a connector for a coaxial cable in accordance with a first embodiment of the present application.
Figure 2B:
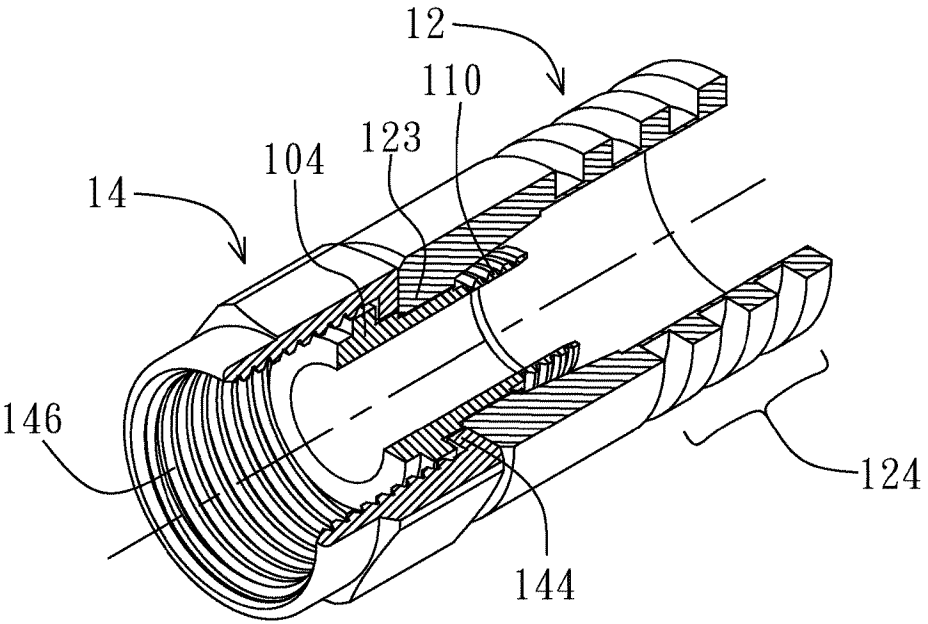
FIG. 2*b* is a cross-sectional perspective view showing an assembly for the connector in accordance with the first embodiment of the present application.
Figure 2C:
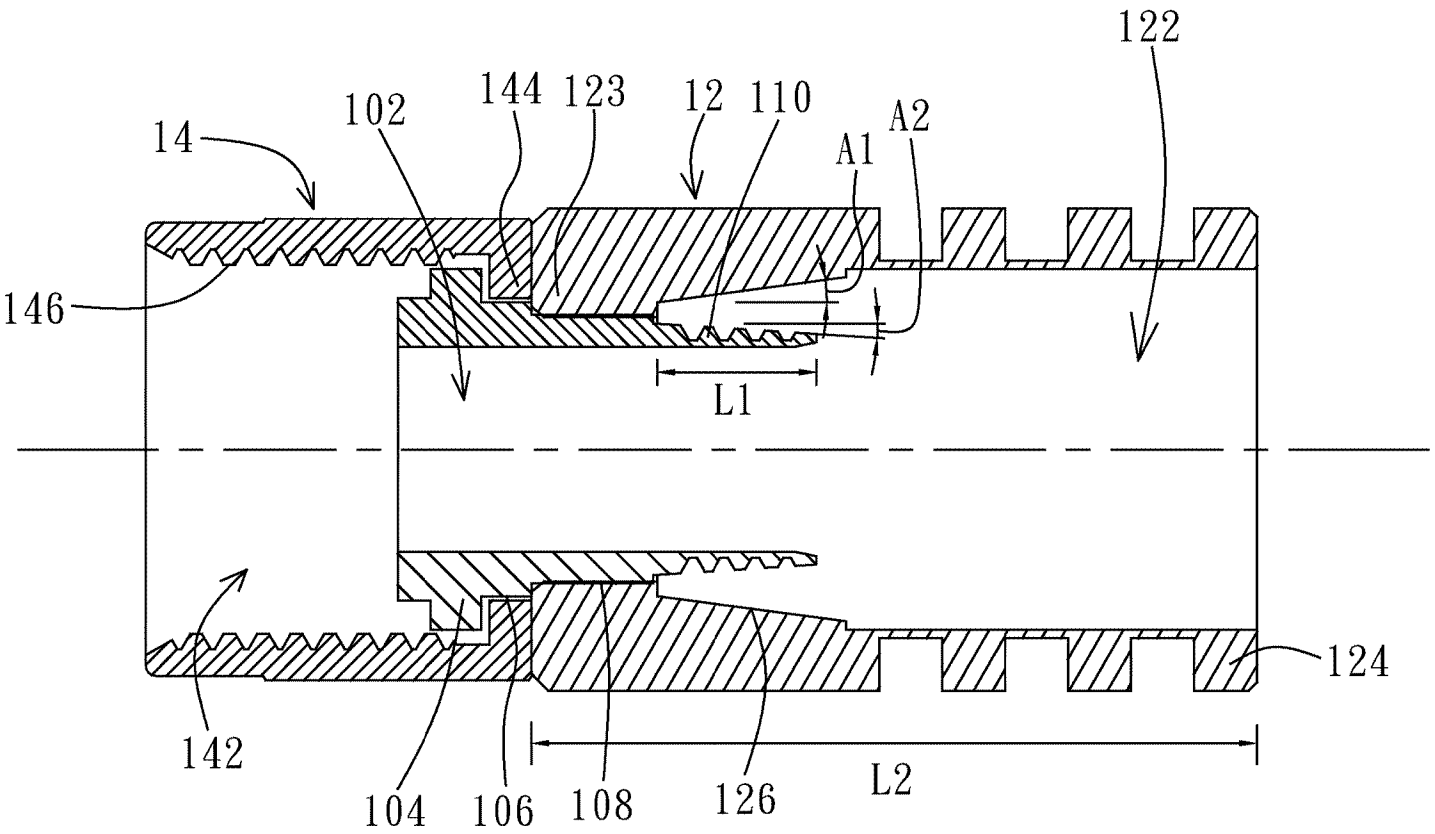
FIG. 2*c* is a cross-sectional view showing the assembly for the connector in accordance with the first embodiment of the present application.

FIG. 2*a* is a cross-sectional perspective view showing multiple elements exploded from a connector for a coaxial cable in accordance with a first embodiment of the present application. FIG. 2*b* is a cross-sectional perspective view showing an assembly for the connector in accordance with the first embodiment of the present application. FIG. 2*c* is a cross-sectional view showing the assembly for the connector in accordance with the first embodiment of the present application. Referring to FIGS. 2*a*-2*c*, a connector for a coaxial cable may include an inner sleeve 10, outer sleeve 12 and nut 14 all coaxially arranged to accommodate the coaxial cable as seen in FIG. 1. Each of the inner sleeve 10, outer sleeve 12 and nut 14 may be made of a conductive material, such as copper, iron, silver, nickel, tin, gold, a copper-gold alloy, a copper-tin alloy, a copper-nickel alloy, brass, a brass alloy, phosphor bronze, beryllium copper, aluminum, an aluminum alloy, a zinc alloy, a steel alloy, a conductive plastic or a non-metal conductor. Each of the inner sleeve 10, outer sleeve 12 and nut 14 may be covered with a rust-proof metal layer, such as copper, iron, silver, nickel, tin or gold, by an electroplating or electroless plating process.

Referring to FIGS. 2*a*-2*c*, a through hole 102 may pass through the inner sleeve 10 in an axis of the inner sleeve 10. The inner sleeve 10 may have an outer flange 104 radially and outwardly protruding from the inner sleeve 10. The inner sleeve 10 may have multiple threads to form a threaded surface 112 on an outer surface of a cylindrical wall of the inner sleeve 10 at a rear-extension portion 110 of the inner sleeve 10. In an axial arrangement of the inner sleeve 10, the inner sleeve 10 may have a first surface 106 between the outer flange 104 and a second surface 108 of the inner sleeve 10, wherein the second surface 108 may be between the first surface 106 and the rear-extension portion 110. A through hole 142 may pass through the nut 14 in an axis of the nut 14 coaxial to the axis of the inner sleeve 10. The nut 14 may have an inner flange 144 radially and inwardly protruding from the nut 14. The nut 14 may have multiple threads to form a threaded surface 146 on an inner surface of the nut 14. The nut 14 may be a hex nut, square nut, ring nut or wing nut that can be used to lock the connector to an electronic device using a wrench or other tool. A through hole 122 may pass through the outer sleeve 12 in an axis of the outer sleeve 12 coaxial to the axes of the inner sleeve 10 and nut 14 and may accommodate the rear-extension portion 110 of the inner sleeve 10. The outer sleeve 12 may have an inner flange 123 radially and inwardly protruding from the outer sleeve 12. The outer sleeve 12 may have a rear-extension portion 124 having an inner diameter greater than an outer diameter of the rear-extension portion 110, wherein the rear-extension portion 124 may have a length greater than that of the rear-extension portion 110.

Referring to FIGS. 2*a*-2*c*, the rear-extension portion 110 of inner sleeve 10 may pass from a front side of the through hole 142 through it in an axial direction such that the inner flange 144 of the nut 14 may abut against the outer flange 104 of the inner sleeve 10, wherein the inner flange 144 of the nut 14 may be radially fitted to the first surface 106 of the inner sleeve 10. The inner flange 123 of the outer sleeve 12 may be tightly and radially fitted to the second surface 108 of the inner sleeve 10. Alternatively, the inner flange 123 of the outer sleeve 12 may be radially mounted to the second surface 108 of the inner sleeve 10 by tolerance fitting, metal sintering or an adhesive. Thereby, the outer sleeve 12 may be fixed to the inner sleeve 10. In an axial arrangement of the connector, the inner flange 144 of the nut 14 may be arranged between the inner flange 123 of the outer sleeve 12 and the outer flange 104 of the inner sleeve 10, and thus may be restricted in axial movement by the inner flange 123 and the outer flange 104. The nut 14 may be prevented from being detached from the inner sleeve 10 and rotated relatively to the inner sleeve 10 and outer sleeve 12. The rear-extension portion 110 of the inner sleeve 10 may be arranged in the through hole 122 in the outer sleeve 12 and an annular space may be formed between the rear-extension portion 110 of the inner sleeve 10 and the rear-extension portion 124 of the outer sleeve 12, wherein the threaded surface 112 of the inner sleeve 10 may face the annular space.

Referring to FIGS. 2*a*-2*c*, the rear-extension portion 110 of the inner sleeve 10 may have an axial length smaller than that of the rear-extension portion 124 of the outer sleeve 12. Alternatively, the rear-extension portion 110 of the inner sleeve 10 may have various axial lengths such that the annular space between the rear-extension portion 110 of the inner sleeve 10 and the rear-extension portion 124 of the outer sleeve 12 may have an axial length L1 that may be between 0.1 and 0.5 times, between 0.2 and 0.6 times, between 0.2 and 0.5 times, between 0.3 and 0.7 times or smaller than 0.3, 0.5 or 0.6 times an axial length L2 of the outer sleeve 12. Alternatively, the axial length L1 of the annular space may be smaller than an axial distance between a rear end of the inner sleeve 10 and a rear end of the through hole 122 in the outer sleeve 12. Besides, an inner surface 126 of a cylindrical wall of the outer sleeve 12, arranged at the rear-extension portion 124 thereof, facing the annular space and the thread surface 112 of the inner sleeve 10 may have an angle A1, such as between 3 and 10 degrees, between 10 and 20 degrees or between 15 and 60 degrees, to an axial direction of the outer sleeve 12. The outer surface of the cylindrical wall of the inner sleeve 10, arranged at the rear-extension portion 110 thereof, facing the annular space and the outer sleeve 12 may have an angle A2, such as between 1 and 5 degrees, between 2 and 6 degrees, between 3 and 10 degrees or between 5 and 15 degrees, to an axial direction of the inner sleeve 10.

Figure 2D:
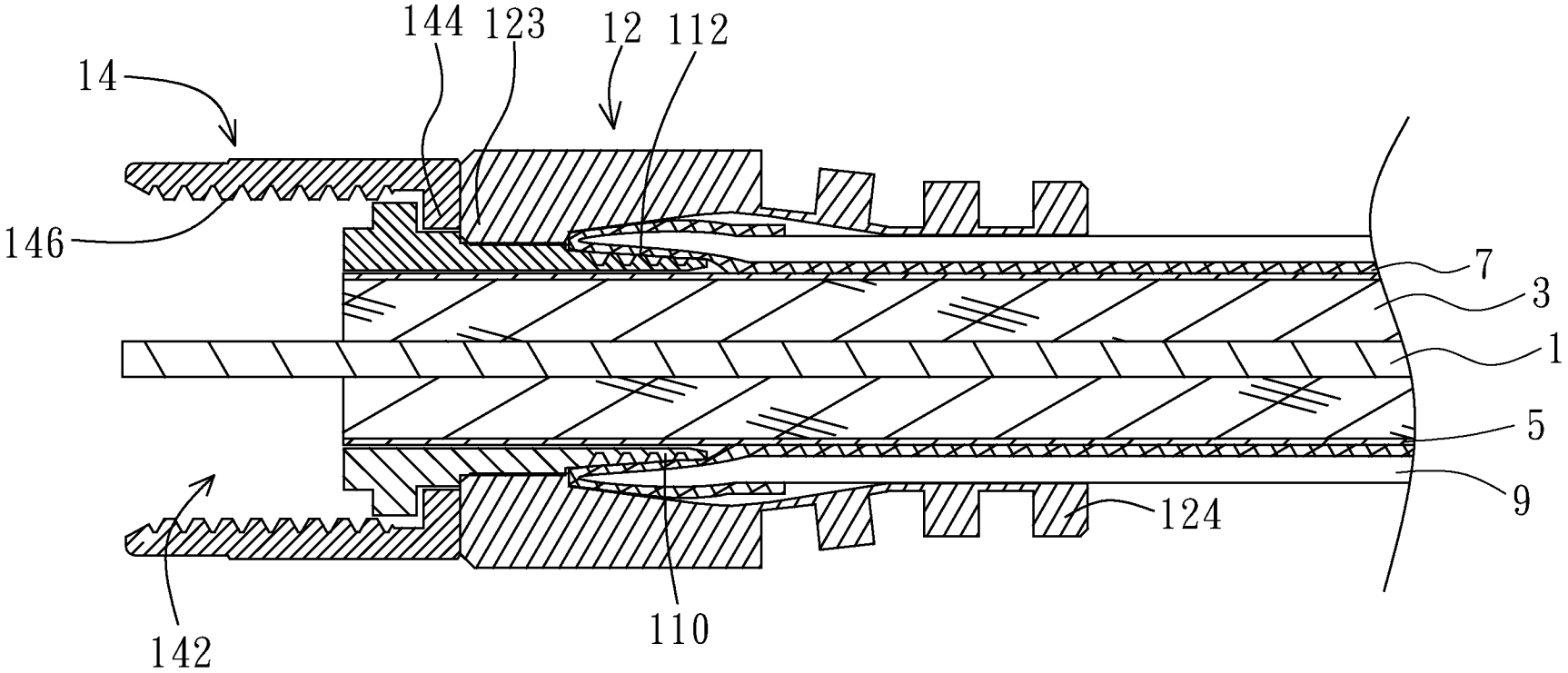
FIG. 2*d* is a cross-sectional view showing the connector assembled with the coaxial cable in accordance with the first embodiment of the present application.

Referring to FIG. 2*d*, when the coaxial cable is assembled to the connector, the braided metal layer 7 and plastic jacket 9 of the coaxial cable as seen in FIG. 1 may have front portions to be first turned inside out to uncover a front portion of the metal film 5 and to have a front portion of the braided metal layer 7 enclose a front portion of the plastic jacket 9. Next, the coaxial cable may be inserted from a rear end of the through hole 122 into it such that the metal wire 1, insulating layer 3 and metal film 5 of the coaxial cable may have front portions to be inserted from a rear end of the through hole 102 into it and the inner sleeve 10 may have the rear-extension portion 110 to be inserted between the braided metal layer 7 the metal film 5. A user may hold the coaxial cable and rotate the connector, and alternatively may further rotate the coaxial cable simultaneously, to drive the rear-extension portion 110 of the inner sleeve 10 to rotate relatively to the coaxial cable and to move in the axial direction to be inserted between the braided metal layer 7 and the metal film 5 by means of the threads on the threaded surface 112 of the inner sleeve 10 to engage with the braided metal layer 7 of the coaxial cable. Meanwhile, the insulating layer 3 and metal film 5 of the coaxial cable may be moved to a front end of the through hole 102 in the inner sleeve 10 and the metal wire 1 may have its front portion moved to a position radially aligned with the thread surface 146 of the nut 14. The front portions of the braided metal layer 7 and plastic jacket 9 may be inserted into the annular space between the rear-extension portion 110 of the inner sleeve 10 and the rear-extension portion 124 of the outer sleeve 12. The rear-extension portion 110 of the inner sleeve 10 may have the threaded surface 112 to be close engaged with the braided metal layer 7 connected to the electrical ground, and thus the connector may have extremely good ground conductivity and bonding strength to the coaxial cable. Accordingly, the connector may not be easily dropped off from the coaxial cable. Next, the rear-extension portion 124 of the outer sleeve 12 may radially pressed to be deformed to abut against the plastic jacket 9 of the coaxial cable and thus the bonding strength between the connector and coaxial cable may be further enhanced.

Second Embodiment

Figure 3A:
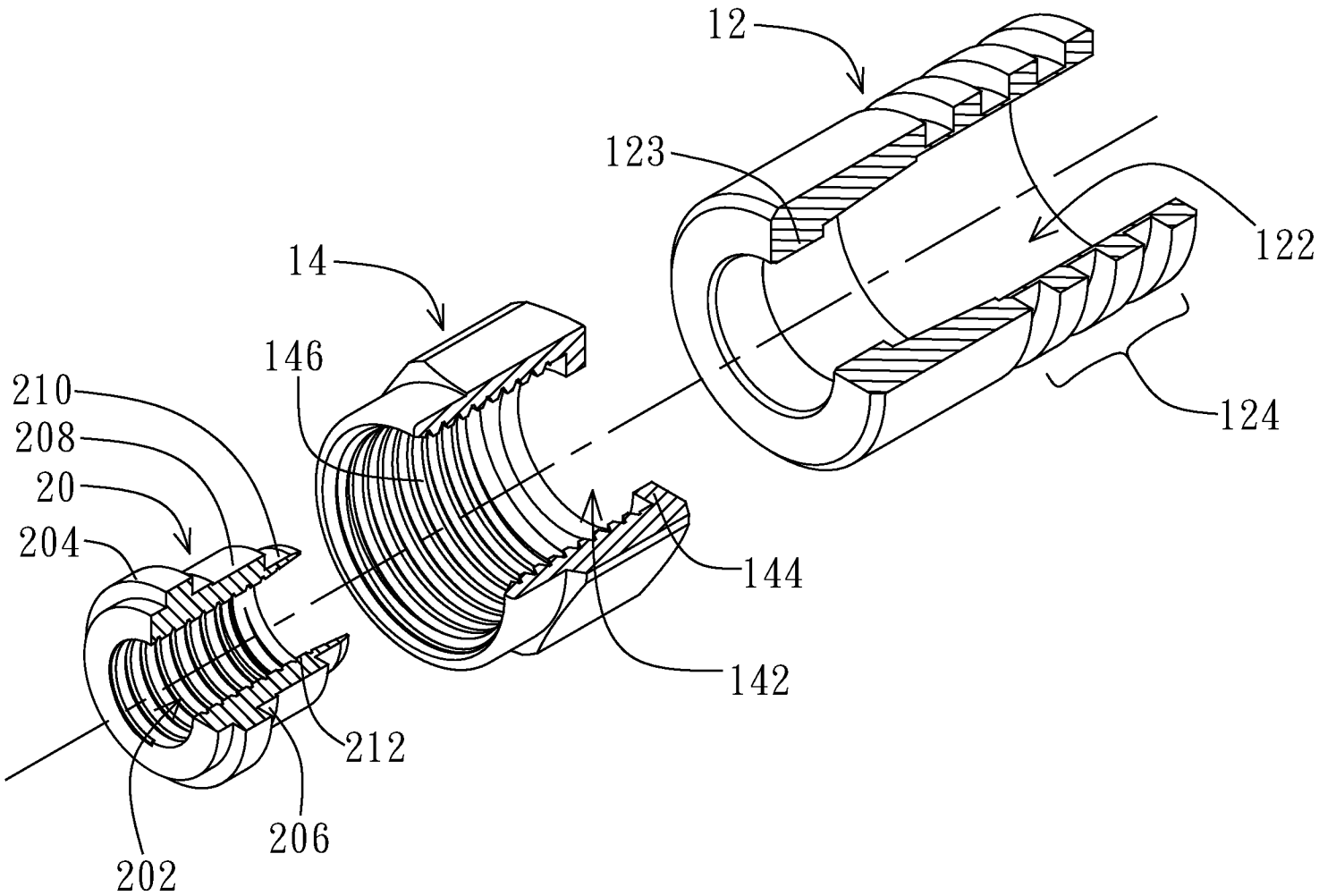
FIG. 3*a* is a cross-sectional perspective view showing multiple elements exploded from a connector for a coaxial cable in accordance with a second embodiment of the present application.
Figure 3B:
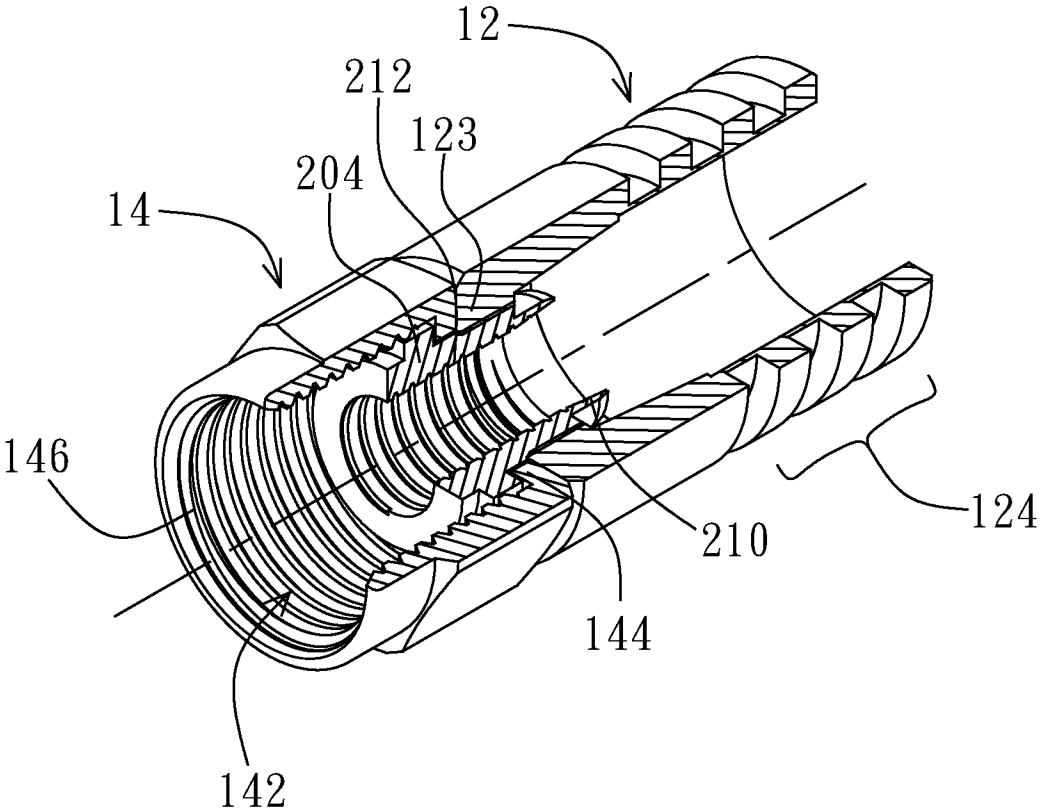
FIG. 3*b* is a cross-sectional perspective view showing an assembly for the connector in accordance with the second embodiment of the present application.
Figure 3C:
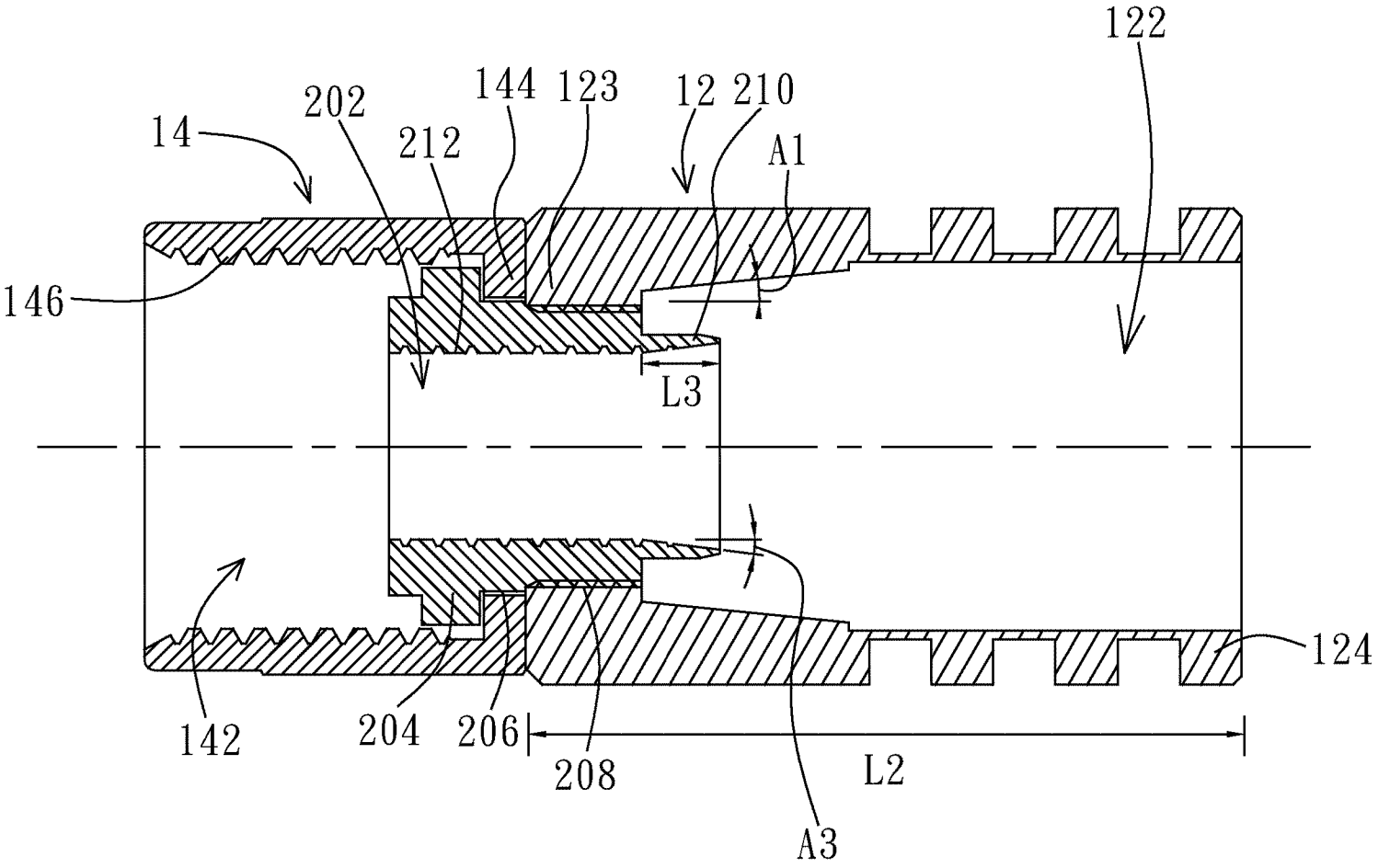
FIG. 3*c* is a cross-sectional view showing the assembly for the connector in accordance with the second embodiment of the present application.

FIG. 3*a* is a cross-sectional perspective view showing multiple elements exploded from a connector for a coaxial cable in accordance with a second embodiment of the present application. FIG. 3*b* is a cross-sectional perspective view showing an assembly for the connector in accordance with the second embodiment of the present application. FIG. 3*c* is a cross-sectional view showing the assembly for the connector in accordance with the second embodiment of the present application. The structure for the connector as illustrated in the second embodiment is similar to that for the connector as illustrated in the first embodiment. When elements indicated by the same reference number in the first and second embodiments, the element in the second embodiment may be referred to the illustration for the element in the first embodiment. The difference between the first and second embodiments is structures of inner sleeves. Referring to FIGS. 3*a*-3*c*, a through hole 202 may pass through the inner sleeve 20 in an axis of the inner sleeve 20. The inner sleeve 20 may have an outer flange 204 radially and outwardly protruding from the inner sleeve 20. The inner sleeve 20 may have multiple threads to form a threaded surface 212 on all of an inner surface of a cylindrical wall of the inner sleeve 20. In an axial arrangement of the inner sleeve 20, the inner sleeve 20 may have a first surface 206 between the outer flange 204 and a second surface 208 of the inner sleeve 20, wherein the second surface 208 may be between the first surface 206 and the rear-extension portion 210. Besides, an inner surface of the cylindrical wall of the inner sleeve 20 arranged at the rear-extension portion 210 thereof may have an angle A3, such as between 1 and 5 degrees, between 2 and 6 degrees or between 5 and 10 degrees, to an axial direction of the inner sleeve 10. The rear-extension portion 210 of the inner sleeve 20 may be arranged in the through hole 122 in the outer sleeve 12 and an annular space may be formed between the rear-extension portion 210 of the inner sleeve 20 and the rear-extension portion 124 of the outer sleeve 12.

Referring to FIGS. 3*a*-3*c*, the rear-extension portion 124 of the outer sleeve 12 may have an inner diameter greater than an outer diameter of the rear-extension portion 210 of the inner sleeve 20, wherein the rear-extension portion 124 may have a length greater than that of the rear-extension portion 210. The rear-extension portion 210 of the inner sleeve 20 may have an axial length smaller than that of the rear-extension portion 124 of the outer sleeve 12. Alternatively, the rear-extension portion 210 of the inner sleeve 20 may have various axial lengths such that the annular space between the rear-extension portion 210 of the inner sleeve 20 and the rear-extension portion 124 of the outer sleeve 12 may have an axial length L3 that may be between 0.1 and 0.5 times, between 0.2 and 0.6 times, between 0.2 and 0.5 times, between 0.3 and 0.7 times or smaller than 0.3, 0.5 or 0.6 times the axial length L2 of the outer sleeve 12. Alternatively, the axial length L3 of the annular space may be smaller than an axial distance between a rear end of the inner sleeve 20 and a rear end of the through hole 122 in the outer sleeve 12.

Figure 3D:
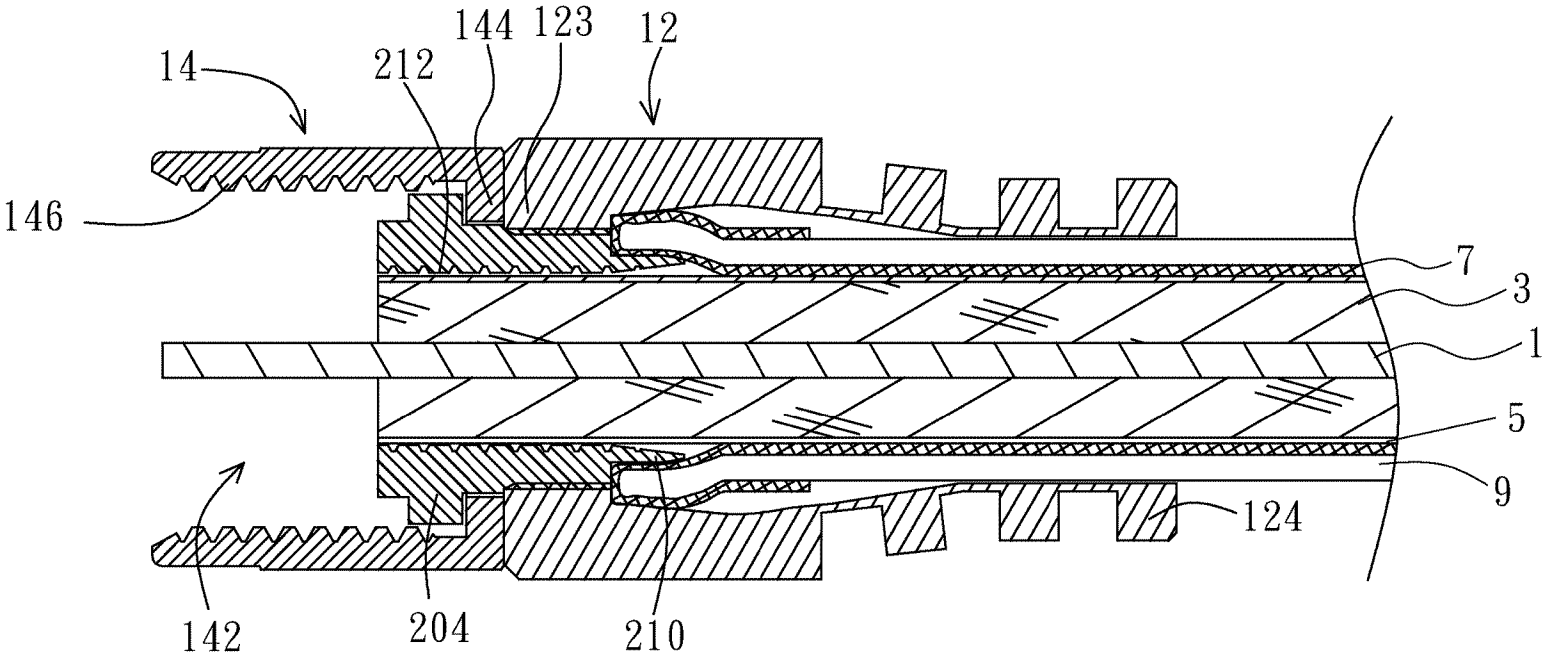
FIG. 3*d* is a cross-sectional view showing the connector assembled with the coaxial cable in accordance with the second embodiment of the present application.

The steps for assembling the inner sleeve 20, nut 14 and outer sleeve 12 are similar to the first embodiment and can be referred to the steps for assembling the inner sleeve 10, nut 14 and outer sleeve 12 as illustrated in the first embodiment. Referring to FIG. 3*d*, when the coaxial cable is assembled to the connector, the braided metal layer 7 and plastic jacket 9 of the coaxial cable as seen in FIG. 1 may have front portions to be first turned inside out to uncover a front portion of the metal film 5 and to have a front portion of the braided metal layer 7 enclose a front portion of the plastic jacket 9. Next, the coaxial cable may be inserted from a rear end of the through hole 122 into it such that the metal wire 1, insulating layer 3 and metal film 5 of the coaxial cable may have front portions to be inserted from a rear end of the through hole 102 into it and the inner sleeve 10 may have the rear-extension portion 110 to be inserted between the braided metal layer 7 the metal film 5. A user may hold the coaxial cable and rotate the connector, and alternatively may further rotate the coaxial cable simultaneously, to drive the rear-extension portion 210 of the inner sleeve 20 to rotate relatively to the coaxial cable and to move in the axial direction to be inserted between the braided metal layer 7 and the metal film 5 by means of the threads on the threaded surface 212 of the inner sleeve 20 to engage with the metal film 5 and insulating layer 3 of the coaxial cable. Meanwhile, the insulating layer 3 and metal film 5 of the coaxial cable may be moved to a front end of the through hole 202 in the inner sleeve 20 and the metal wire 1 may have its front portion moved to a position radially aligned with the thread surface 146 of the nut 14. The inner sleeve 20 may have the threaded surface 212 to be close engaged with the metal film 5 and insulating layer 3 of the coaxial cable, and thus the connector may have extremely good ground conductivity and bonding strength to the coaxial cable. Accordingly, the connector may not be easily dropped off from the coaxial cable. Next, the rear-extension portion 124 of the outer sleeve 12 may radially pressed to be deformed to abut against the plastic jacket 9 of the coaxial cable and thus the bonding strength between the connector and coaxial cable may be further enhanced.

Third Embodiment

Figure 4B:
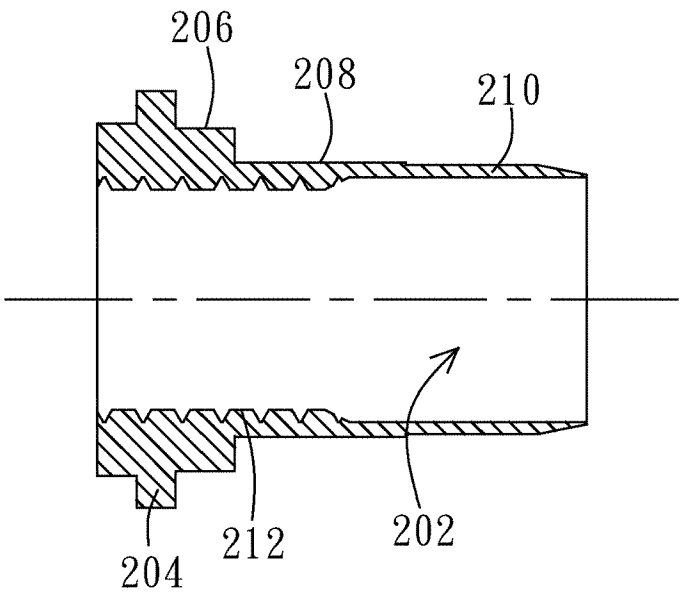
FIG. 4*b* is a cross-sectional perspective view showing the inner sleeve in accordance with the third embodiment of the present application.
Figure 4A:
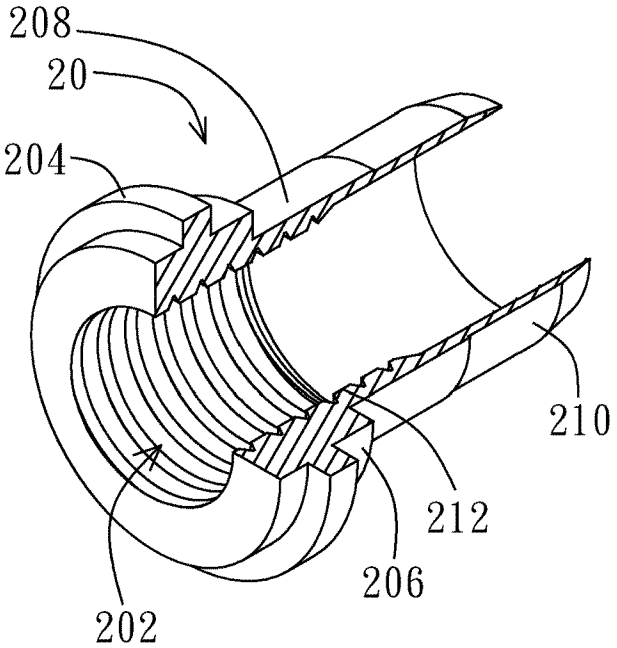
FIG. 4*a* is a cross-sectional perspective view showing an inner sleeve in accordance with a third embodiment of the present application.
Figure 4C:
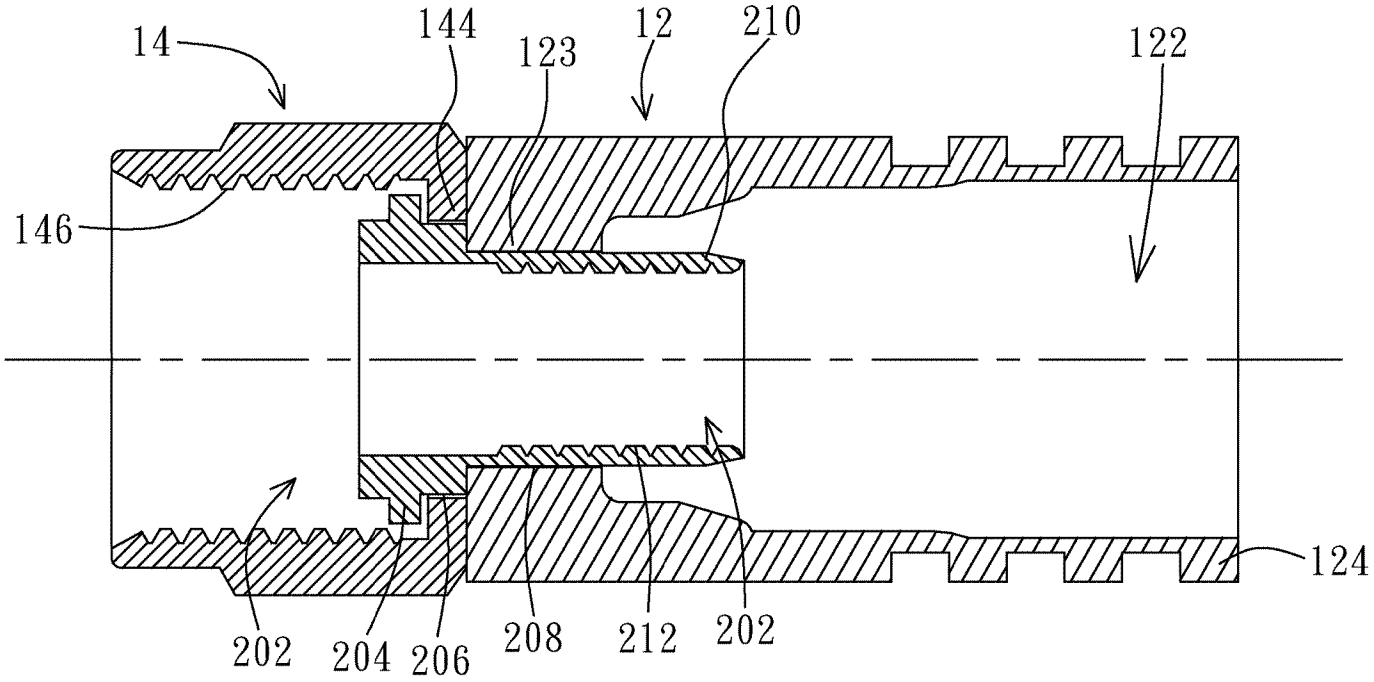
FIGS. 4*c*-4*f* are cross-sectional views showing the assemblies for various types of connectors for a coaxial cable in accordance with the third embodiment of the present application.
Figure 4D:
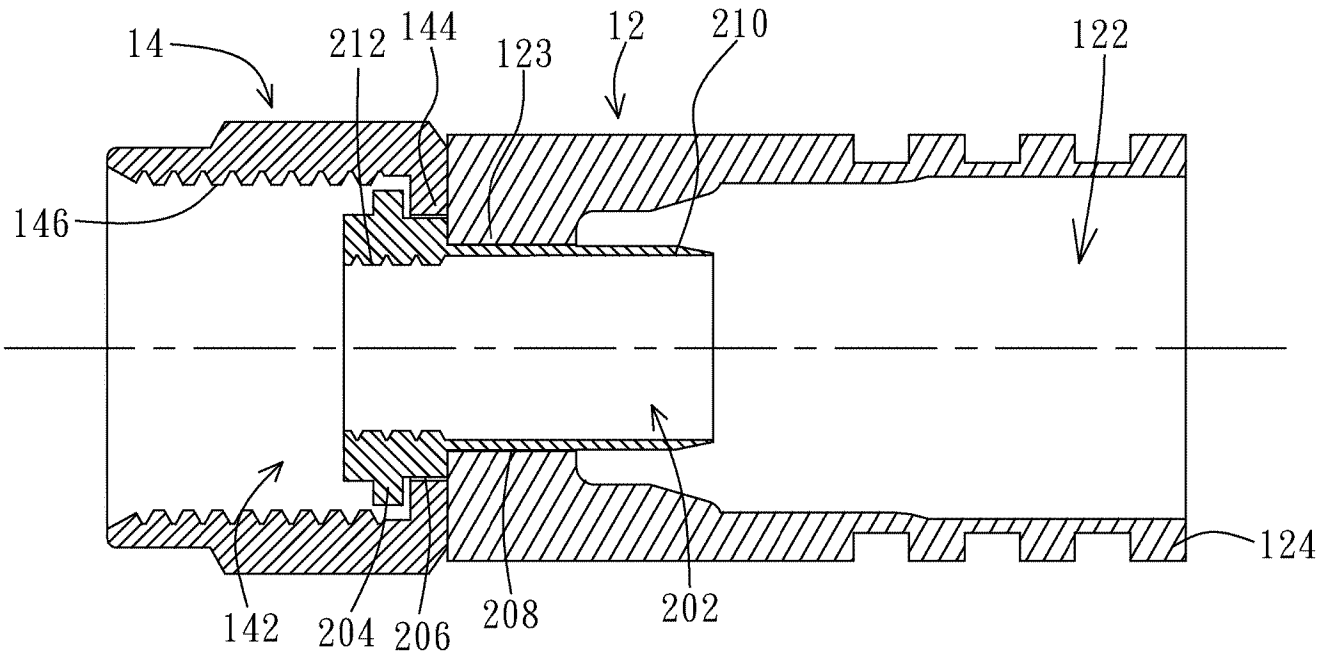
Figure 4E:
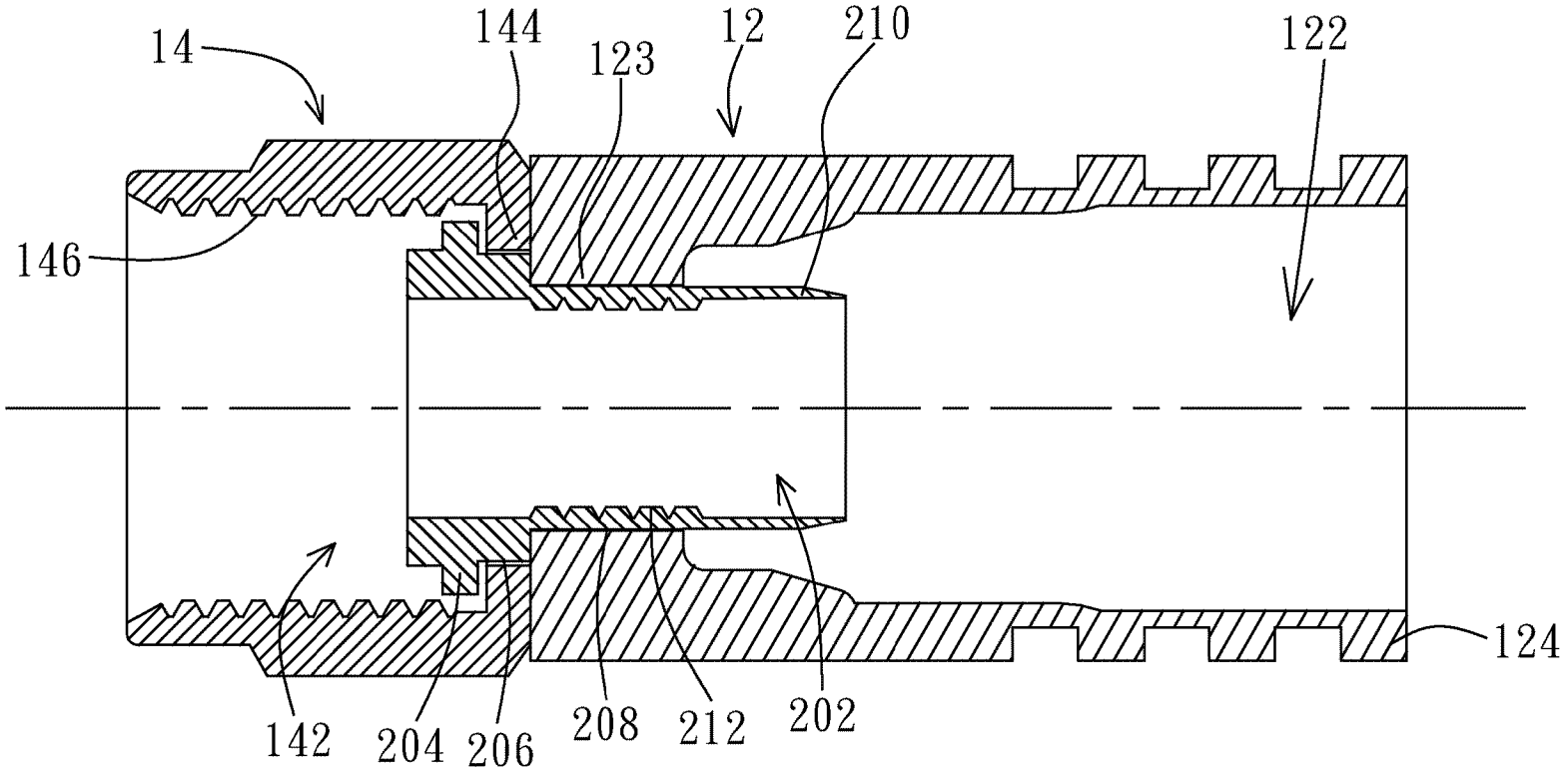
Figure 4F:
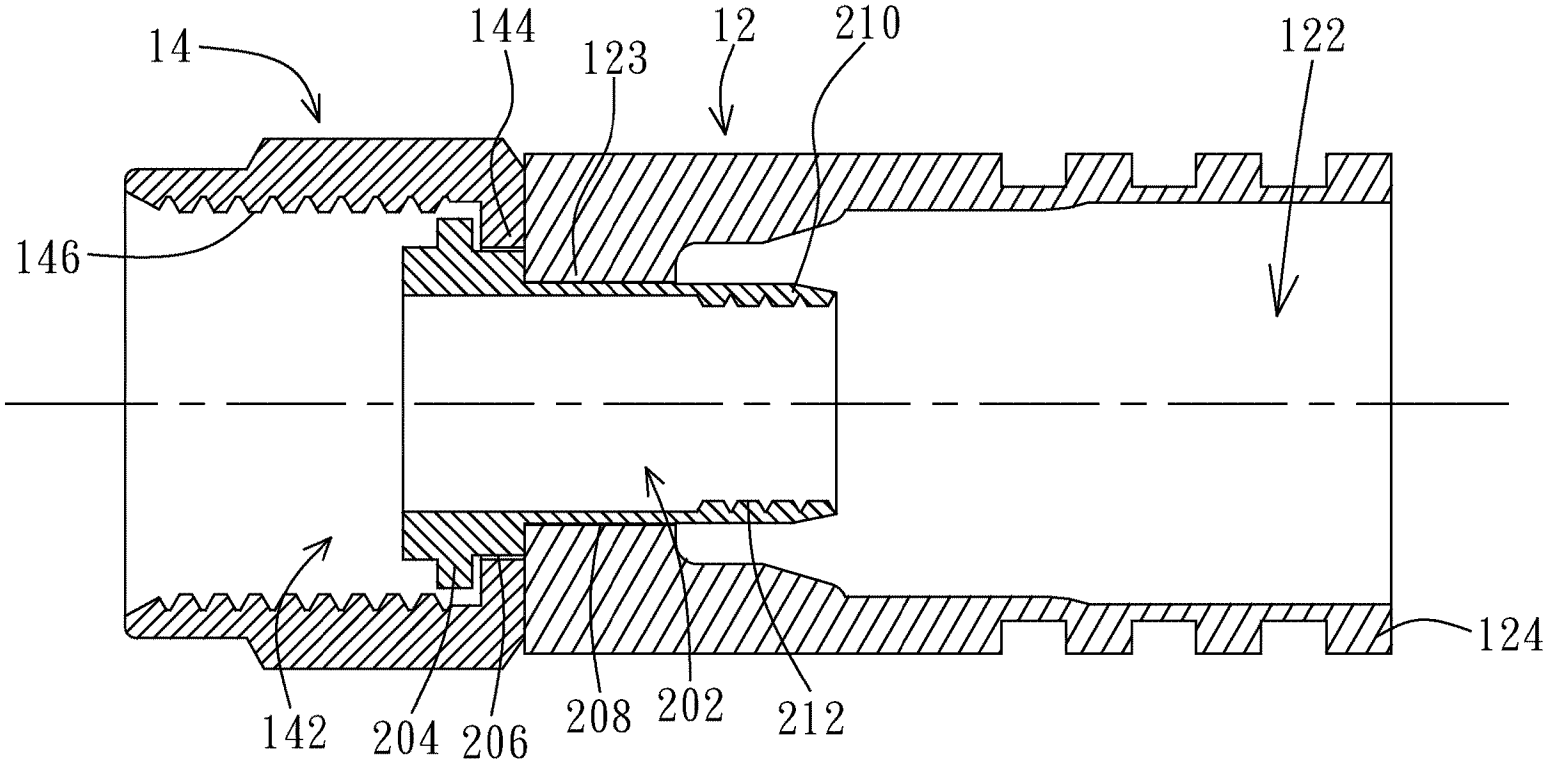

FIG. 4*a* is a cross-sectional perspective view showing an inner sleeve in accordance with a third embodiment of the present application. FIG. 4*b* is a cross-sectional perspective view showing the inner sleeve in accordance with the third embodiment of the present application. The structure for the connector as illustrated in the third embodiment is similar to that for the connector as illustrated in the first and second embodiments. When elements indicated by the same reference number in the first through third embodiments, the element in the third embodiment may be referred to the illustration for the element in the first and second embodiments. Referring to FIGS. 4*a* and 4*b*, the difference between the second and third embodiments is that the inner sleeve 20 may have multiple threads to form a threaded surface 212 on part of the inner surface of the cylindrical wall of the inner sleeve 20. In this case, an area for the threaded surface 212 of the inner sleeve 20 may be 50% of an area of the inner surface of the cylindrical wall of the inner sleeve 20. The threads may spread on the inner surface of the cylindrical wall of the inner sleeve 20 and from a front end of the inner surface of the cylindrical wall of the inner sleeve 20 to a position of the inner surface radially aligned with the inner flange 123 of the outer sleeve 12 radially mounted to the second surface 208 of the inner sleeve 20 so as to form the threaded surface 212. Alternatively, the area for the threaded surface 212 of the inner sleeve 20 may be between 10% and 30%, between 5% and 20%, between 40% and 70% or between 50% and 80% of the total area of the inner surface of the cylindrical wall of the inner sleeve 20. The threads may be formed on any area of the inner surface of the cylindrical wall of the inner sleeve 20 to form the threaded surface. Alternatively, as seen in FIG. 4*c*, the threads may spread on the inner surface of the cylindrical wall of the inner sleeve 20 and from a position of the inner surface radially aligned with the inner flange 123 of the outer sleeve 12 to a rear end of the inner surface. Alternatively, as seen in FIG. 4*d*, the threads may spread on the inner surface of the cylindrical wall of the inner sleeve 20 and be radially aligned with the outer flange 204 of the inner flange 20. Alternatively, as seen in FIG. 4*e*, the threads may spread on the inner surface of the cylindrical wall of the inner sleeve 20 and be radially aligned with the inner flange 123 of the outer flange 12. Alternatively, as seen in FIG. 4*f*, the threads may spread on the inner surface of the cylindrical wall of the inner sleeve 20 and be radially aligned with the rear-extension portion 124 of the outer sleeve 12.

First Derivatives:

In view of the inner sleeve 10 or 20 being designed with relatively short rear-extension portion 110 or 210, a guide element may be further mounted to the connector to guide the coaxial cable to be easily assembled to the connector, that is, the metal wire 1, insulating layer 3 and metal film 5 of the coaxial cable may be precisely aligned with the through hole 102 or 202 in the inner sleeve 10 or 20. In the following paragraphs, the guide element is an example to be mounted to the connector illustrated in the third embodiment, but may be mounted to the connectors illustrated in the first and second embodiments.

Figure 5A:
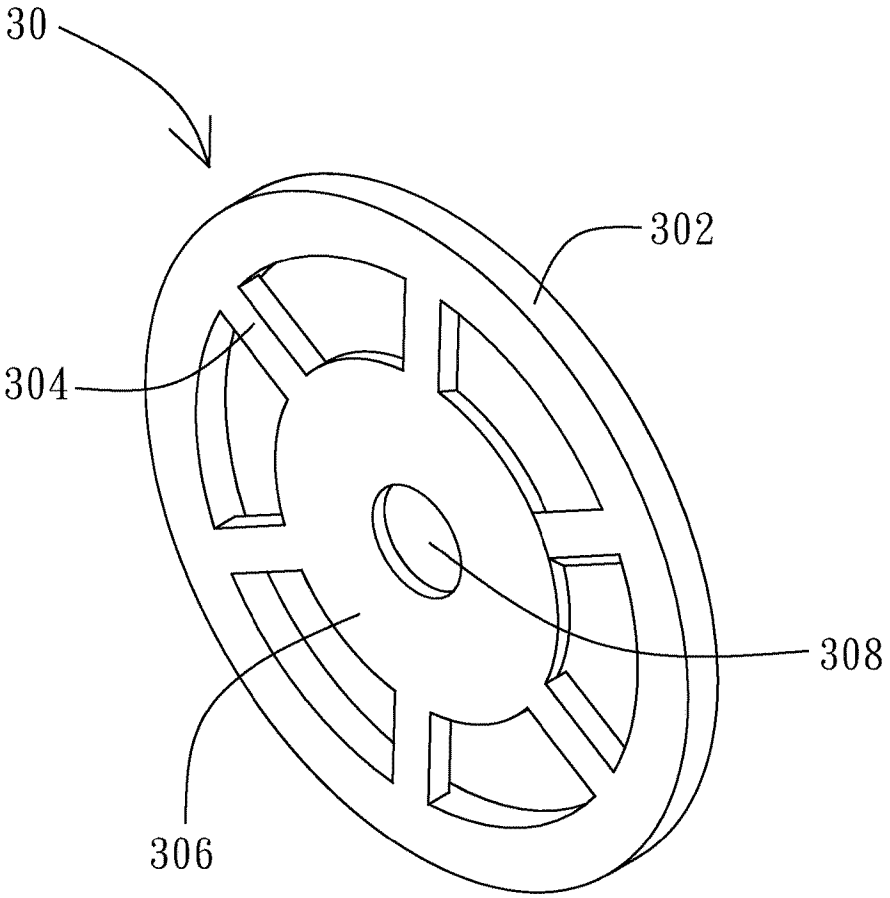
FIG. 5*a* is a perspective view showing a first type of guide element in accordance with the first through third embodiments of the present application.

FIG. 5*a* is a perspective view showing a first type of guide element in accordance with the first through third embodiments of the present application. Referring to FIG. 5*a*, the first type of guide element 30 is sheet including a circular plate 306, multiple longitudinal portions 304 radially arranged with respect to the circular plate 306 and each having an inner end coupling the circular plate 306, and an annular portion 302 coupling outer ends of the longitudinal portions 304. The annular portion 302 may have an outer diameter smaller than an inner diameter of the through hole 122 in the outer sleeve 12 at the rear end thereof. A through hole 308 in the circular plate 306 has a diameter greater than that of the metal wire 1. In this case, the plate 306 is circular, but alternatively may have another profile, such as square, triangle or polygon. The plate 206 may have an outer diameter or greatest width smaller than an outer diameter of the insulating layer 3 of the coaxial cable.

The annular portion 302 may be made of the same material as the longitudinal portions 304 are made, wherein the material may be iron, silver, nickel, tin, gold, a copper-gold alloy, a copper-tin alloy, a copper-nickel alloy, brass, a brass alloy, phosphor bronze, beryllium copper, aluminum, an aluminum alloy, a zinc alloy, or a steel alloy, but the circular plate 306 may be made of a non-conductive material, such as a plastic, a polymer, high-density polyethylene, polyethylene terephthalate, polyvinyl chloride, polypropylene, polystyrene or polycarbonate. Alternatively, the annular portion 302 may be made of the same material as the longitudinal portions 304 and circular plate 306 are made, wherein the material may be non-conductive, such as a plastic, a polymer, high-density polyethylene, polyethylene terephthalate, polyvinyl chloride, polypropylene, polystyrene or polycarbonate.

Figure 5B:
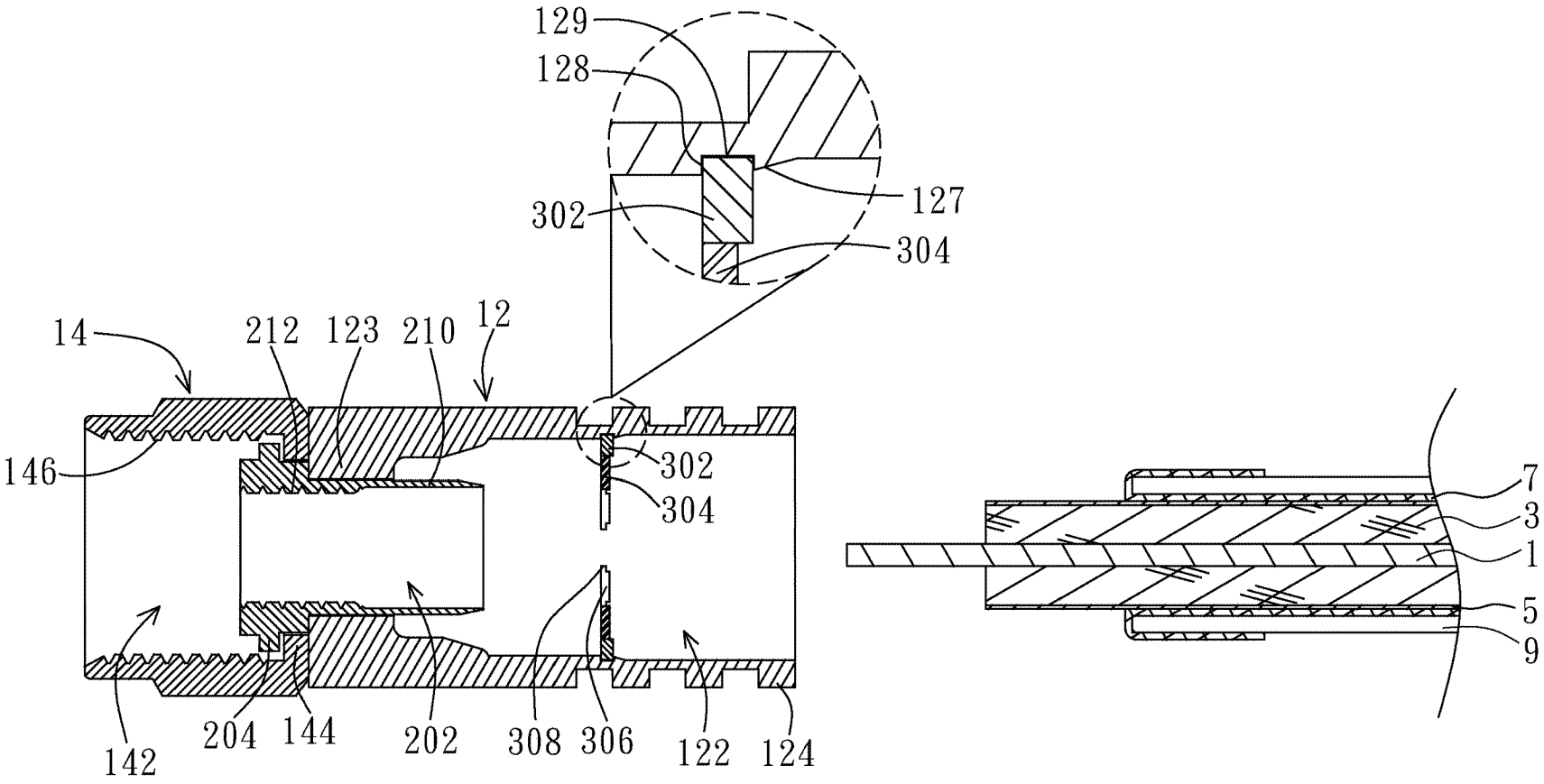
FIGS. 5*b*-5*d* are cross-sectional views showing a process for assembling the coaxial cable to a connector assembled with the first type of guide element in accordance with the first through third embodiments of the present application.
Figure 5C:
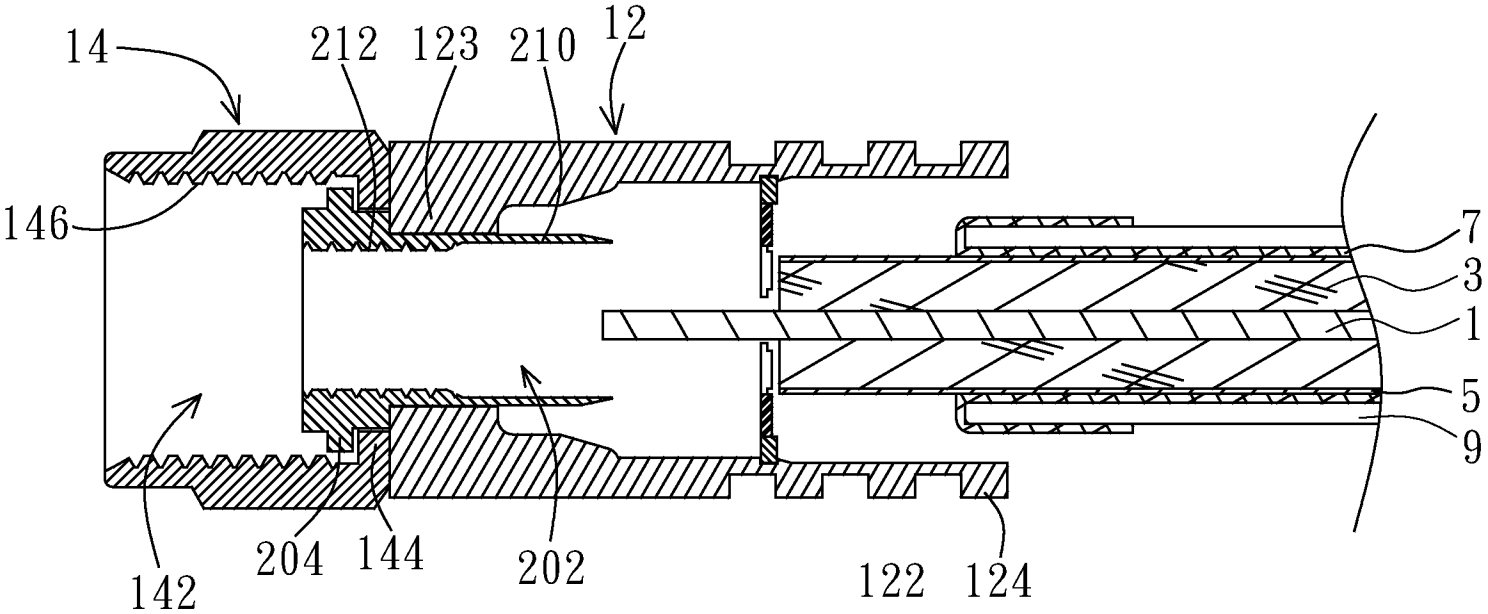
Figure 5D:
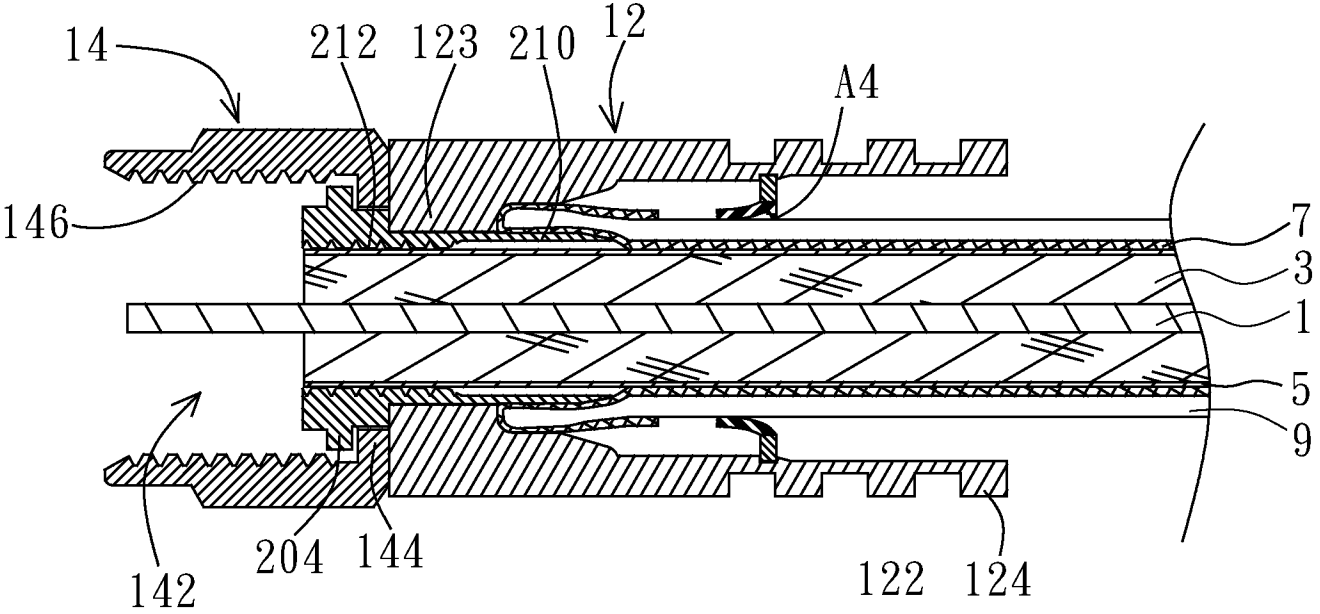

FIGS. 5*b*-5*d* are cross-sectional views showing a process for assembling the coaxial cable to a connector assembled with the first type of guide element in accordance with the first through third embodiments of the present application. Referring to FIGS. 5*b*-5*d*, for mounting the guide element 30 to the outer sleeve 12, an annular groove 129 may be formed around the through hole 122 in the outer sleeve 12 for accommodating a periphery of the guide element 30. The outer sleeve 12 may have an annular slopped protrusion 127 and annular stop 128 both formed around the through hole 122 in the outer sleeve 12, wherein the annular groove 129 is formed axially between the annular slopped protrusion 127 and annular stop 128. The guide element 30 may be inserted from a rear end of the through hole 122 in the outer sleeve 12 into it, the annular sloped portion 127 may have a slope to lead the guide element 30 to be gradually deformed to pass through a neck surrounded by the annular slopped protrusion 127. After the guide element 30 passes through the neck, the guide element 30 may be returned to its original shape to be locked by the annular groove 129 and stop between the annular stop 128 and annular sloped portion 127. Thereby, the guide element 30 may be fixed in the through hole 122 in the outer sleeve 12.

When the coaxial cable is assembled to the connector, the coaxial cable is first processed to expose the metal wire 1 to pass through the through hole 308 in the circular plate 306 until the insulating layer 3 of the coaxial cable having a front end abutting against the circular plate 306. Next, a user continues to push the coaxial cable to be axially moved towards the nut 14, in which the circular plate 306 may be pushed by the coaxial cable to separate from the longitudinal portions 304, and the longitudinal portions 304 may be deformed by the movement of coaxial cable to be bent towards the nut 14, wherein the bent longitudinal portions 304 may abut against the plastic jacket 9 of the coaxial cable. Each of the deformed longitudinal portions 304 may have an angle A4 between 5 and 20 degrees, between 10 and 30 degrees, between 30 and 60 degrees, for example, to a radial direction of the outer sleeve 12. The bent longitudinal portions 304 may restrict the coaxial cable not to be radially moved but guide the coaxial cable to be axially moved towards the nut 14. Thereby, the insulating layer 3 of the coaxial cable may have a front surface pushing the circular plate 306 to be axially moved into the through hole 202 in the inner sleeve 20 when the insulating layer 3 and metal film 5 of the coaxial cable are pushed to be moved into the through hole 202. Next, the user may hold the coaxial cable and rotate the connector, and alternatively may further rotate the coaxial cable simultaneously, to drive the rear-extension portion 210 of the inner sleeve 20 to rotate relatively to the coaxial cable and to move in the axial direction to be inserted between the braided metal layer 7 and the metal film 5 by means of the threads on the threaded surface 212 of the inner sleeve 20 to engage with the metal film 5 and insulating layer 3 of the coaxial cable. Meanwhile, the insulating layer 3 and metal film 5 of the coaxial cable may be moved to a front end of the through hole 202 in the inner sleeve 20 and the metal wire 1 may have its front portion moved to a position radially aligned with the thread surface 146 of the nut 14. The circular plate 306 may be driven to be removed from a front end of the through hole 142 in the nut 14.

Figure 6A:
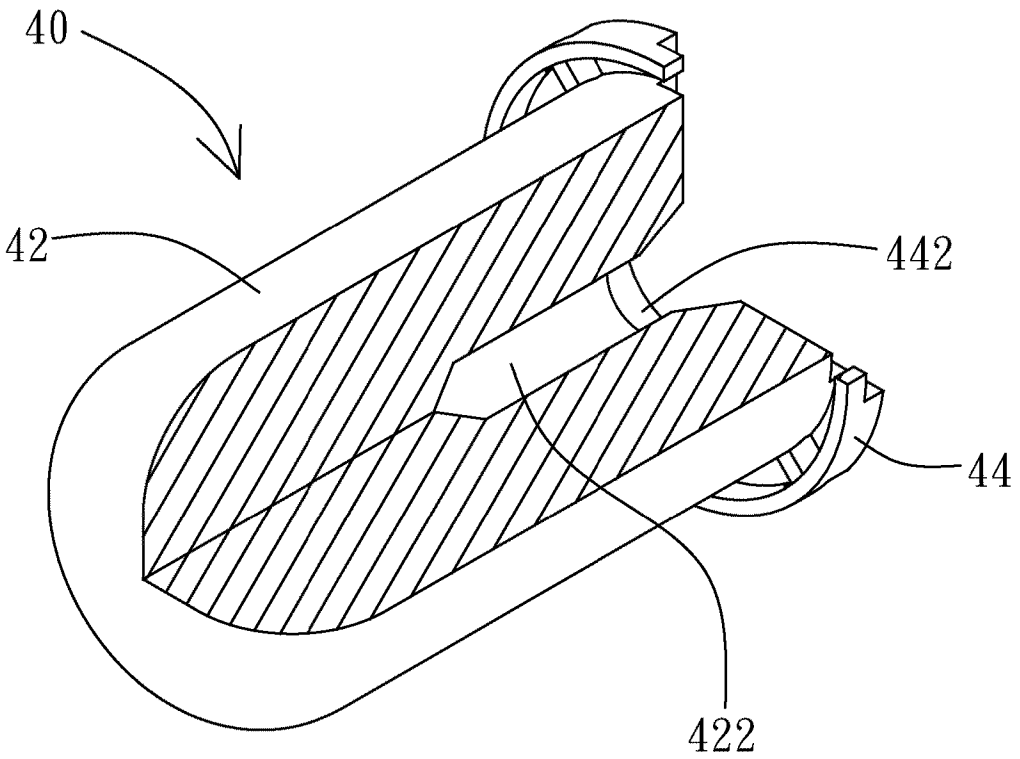
FIG. 6*a* is a perspective view showing a second type of guide element in accordance with the first through third embodiments of the present application.

FIG. 6*a* is a perspective view showing a second type of guide element in accordance with the first through third embodiments of the present application. Referring to FIG. 6*a*, a second type of guide element 40 may include a flexible cylinder 42 and a flexible pedestal 44 attached to a rear surface of the flexible cylinder 42. The flexible pedestal 44 has a flexible flange radially and outwardly protruding from the flexible cylinder 42. The flexible cylinder 42 may have a front portion with an outer diameter smaller than an outer diameter of a rear portion of the flexible cylinder 42, and the outer diameter of the rear portion of the flexible cylinder 42 is smaller than an outer diameter of the flexible pedestal 44. A hole 422 extending in an axis of the flexible cylinder 42 may be aligned with an opening 442 in the flexible pedestal 44, wherein the hole 422 may have a diameter greater than or equal to that of the opening 442, and both of the hole 422 and opening 442 may have diameters greater than that of the metal wire 1 of the coaxial cable. The flexible cylinder 42 may be made of a sponge, polymer or rubber. The flexible pedestal 44 may be made of a flexible plastic or metallic material, such as high-density polyethylene, polyethylene terephthalate, polyvinyl chloride, polypropylene, polystyrene or polycarbonate. In this case, the flexible pedestal 44 may be circular, but alternatively may be rectangular, triangular or polygonal. The flexible pedestal 44 may be made of the same material as the flexible cylinder 42 is made. Alternatively, the flexible cylinder 42 and flexible pedestal 44 may be formed as a single integral part. The flexible pedestal 44 has an outer diameter greater than that of the insulating layer 3 of the coaxial cable and that of the rear-extension portion 210 of the inner sleeve 20 but smaller than an inner diameter of the rear-extension portion 124 of the outer sleeve 12. In this case, the flexible cylinder 42 may be circular, but alternatively may be rectangular, triangular or polygonal. Alternatively, the flexible cylinder 42 may include multiple bumps radially protruding from the flexible cylinder 42. Alternatively, the flexible cylinder 42 may have a middle portion with an outer diameter greater than those of front and rear portions of the flexible cylinder 42. Alternatively, the flexible cylinder 42 may have a middle portion with an outer diameter smaller than those of front and rear portions of the flexible cylinder 42.

Figure 6B:
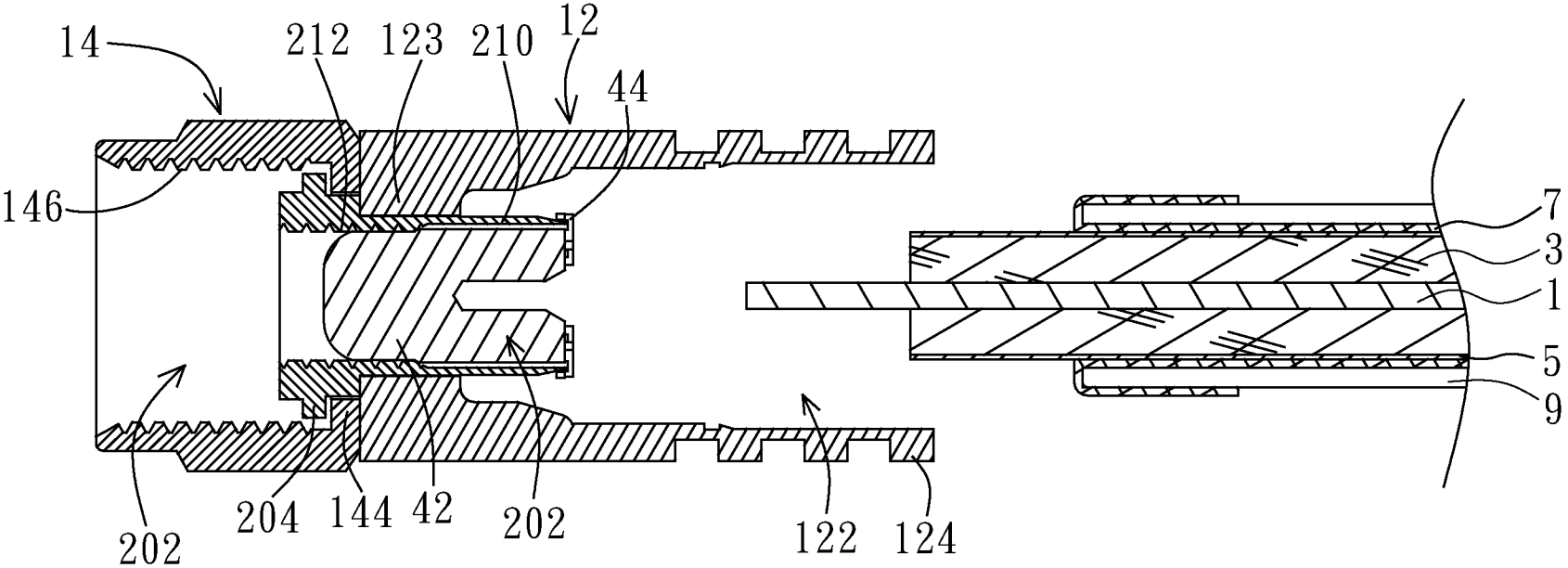
FIGS. 6*b*-6*c* are cross-sectional views showing a process for assembling the coaxial cable to a connector assembled with the second type of guide element in accordance with the first through third embodiments of the present application.
Figure 6C:
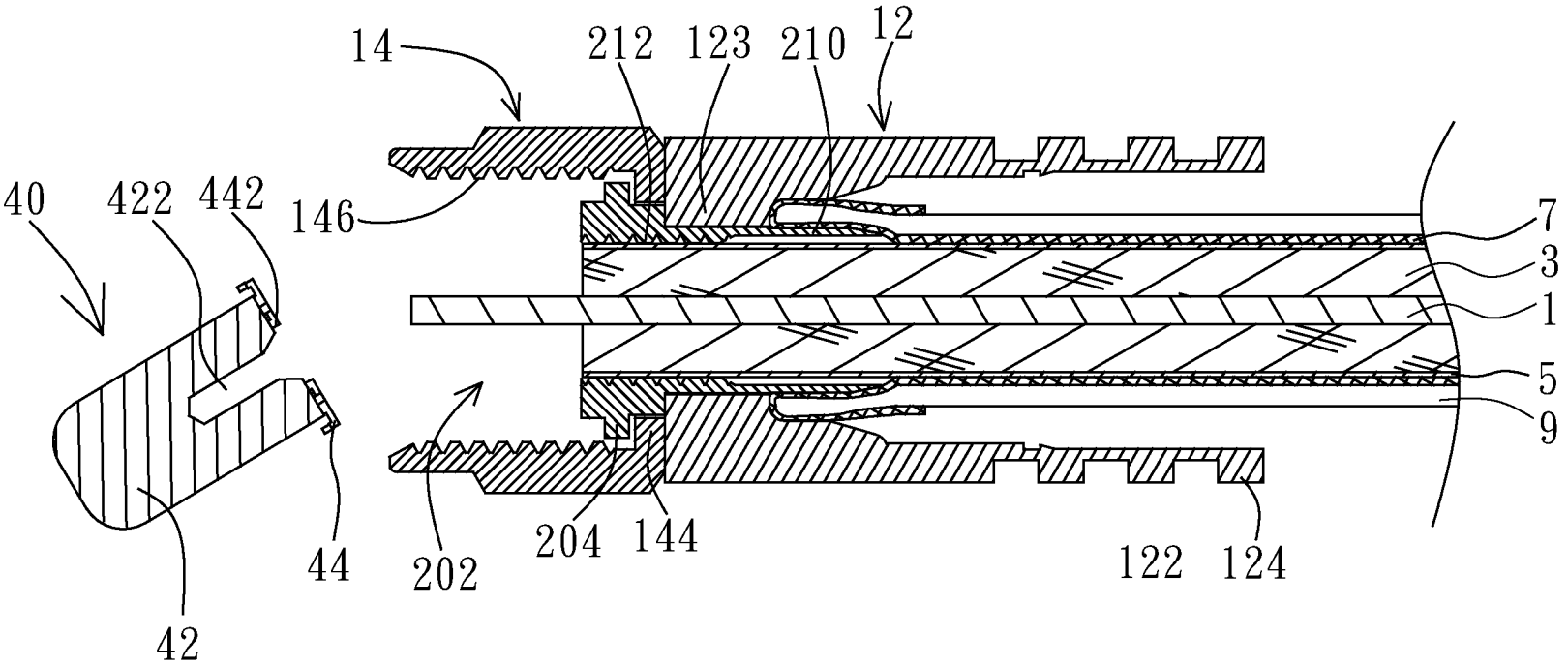

Referring to FIGS. 6*b* and 6*c*, a user may first insert the guile element 40 from the rear end of the through hole 122 in the outer sleeve 12 into it and further insert the flexible cylinder 42 of the guile element 40 from the rear end of the through hole 202 in the inner sleeve 20 into it. The flexible cylinder 42 of the guile element 40 may be radially deformed or pressed by the cylindrical wall of the inner sleeve 20 to have a reduced diameter to lead the flexible cylinder 42 of the guile element 40 to be smoothly inserted into the through hole 202 in the inner sleeve 20 until the flexible flange of the flexible pedestal 44 contacts the rear end of the rear-extension portion 210 of the inner sleeve 20. When the coaxial cable is assembled to the connector, the coaxial cable is first processed to expose the metal wire 1 to pass through the opening 442 in the flexible pedestal 44 and the hole 422 in the flexible cylinder 42. Next, the user continues to push the coaxial cable to be axially moved towards the nut 14, in which the flexible pedestal 44 may be deformed, broken or pressed by the cylindrical wall of the inner sleeve 20 to be squeezed into the through hole 202 in the inner sleeve 20. Next, the user may hold the coaxial cable and rotate the connector, and alternatively may further rotate the coaxial cable simultaneously, to drive the rear-extension portion 210 of the inner sleeve 20 to rotate relatively to the coaxial cable and to move in the axial direction to be inserted between the braided metal layer 7 and the metal film 5 by means of the threads on the threaded surface 212 of the inner sleeve 20 to engage with the metal film 5 and insulating layer 3 of the coaxial cable. Meanwhile, the insulating layer 3 and metal film 5 of the coaxial cable may be moved to a front end of the through hole 202 in the inner sleeve 20 and the metal wire 1 may have its front portion moved to a position radially aligned with the thread surface 146 of the nut 14. The guide element 40 may be driven to be removed from a front end of the through hole 142 in the nut 14. In this case, the guide element 40 may be recycled.

Second Derivatives:

Each of the rear-extension portion 110 of the inner sleeve 10 and rear-extension portion 210 of the inner sleeve 20 as illustrated in the above embodiments may have an alternative structure at the rear end thereof as seen in FIGS. 7*a*-7*g*. In the following paragraphs, the rear-extension portion 110 of the inner sleeve 10 in the first embodiment is an example to be formed with the alternative structure, but the rear-extension portion 210 of the inner sleeve 20 in the second or third embodiments may also be formed with the alternative structure.

Figure 7A:
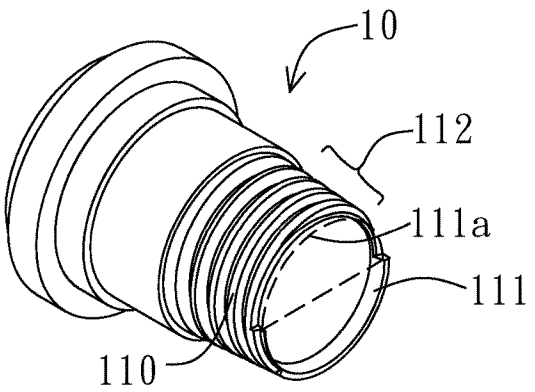
FIGS. 7*a*-7*g* are perspective views showing various derivatives from a rear-extension portion of an inner sleeve in accordance with the first through third embodiments of the present application.
Figure 7B:
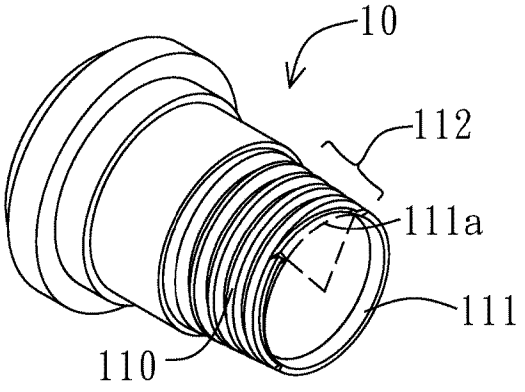

Referring to FIG. 7*a*, the rear-extension portion 110 of inner sleeve 10 may have an arcuate bump 111 axially protruding from a rear end thereof, wherein the arcuate bump 111 may have a radian between 90 and 270 degrees, between 30 and 150 degrees, between 30 and 120 degrees, between 60 and 210 degrees or greater than 30 or 210 degrees with respect to the axis of the inner sleeve 10. An arcuate cut 111*a* are circumferentially between two ends of the arcuate bump 111. Referring to FIG. 7*b*, the arcuate bump 111 may have a radian greater than 270 degrees, such as 300 degrees.

Figure 7C:
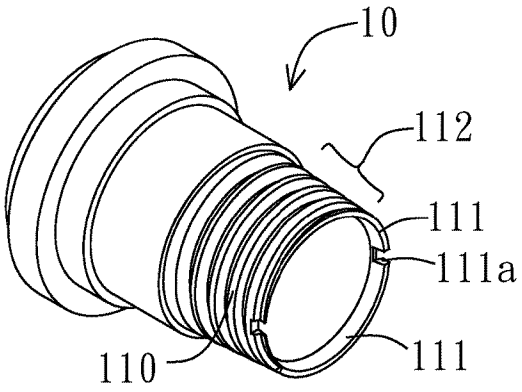
Figure 7D:
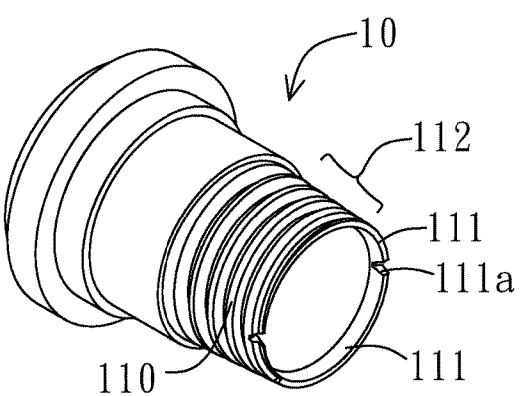
Figure 7F:
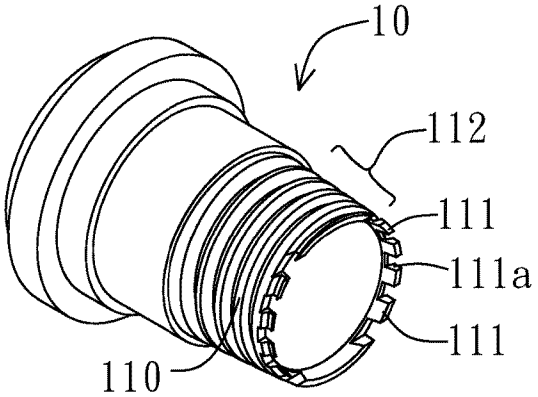
Figure 7E:
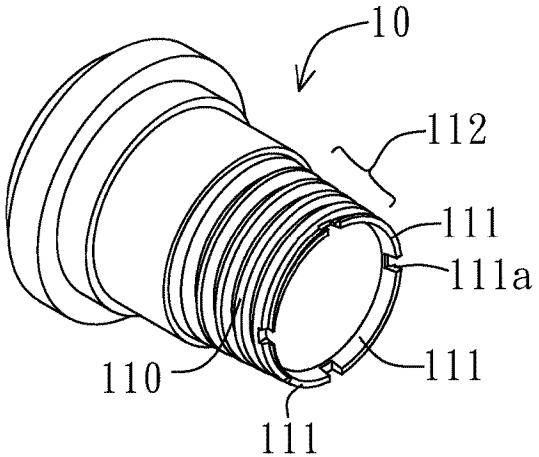

Referring to FIGS. 7*c*-7*e*, the rear-extension portion 110 of inner sleeve 10 may have multiple arcuate bumps 111 axially protruding from the rear end thereof, wherein each of the arcuate bumps 111 may have the same radian with respect to the axis of the inner sleeve 10. A cut 111*a* having a rectangular, v-shaped or circular profile may be circumferentially formed between neighboring two of the arcuate bumps 111. As seen in FIG. 7*c*, the rear-extension portion 110 of inner sleeve 10 may have two arcuate bumps 111 axially protruding from the rear end thereof and a rectangular cut 111*a* may be circumferentially formed between neighboring two sides of the two arcuate bumps 111. Alternatively, as seen in FIG. 7*d*, a v-shaped cut 111*a* may be circumferentially formed between neighboring two sides of the two arcuate bumps 111. Alternatively, as seen in FIG. 7*e*, the rear-extension portion 110 of inner sleeve 10 may have four arcuate bumps 111 axially protruding from the rear end thereof and a rectangular cut 111*a* may be circumferentially formed between neighboring two of the four arcuate bumps 111.

Referring to FIG. 7*f*, the rear-extension portion 110 of inner sleeve 10 may have multiple arcuate bumps 111 axially protruding from the rear end thereof. Each of the arcuate bumps 111 in a first group may have a radian with respect to the axis of the inner sleeve 10 different from that of each of the arcuate bumps 111 in a second group. In this case, the arcuate bumps 111 in the first group may be arranged at top and bottom sides and have the same first radian with respect to the axis of the inner sleeve 10. The arcuate bumps 111 in the second group may be arranged at left and right sides and have the same second radian with respect to the axis of the inner sleeve 10, wherein the second radian is smaller than the first radian. A rectangular cut 111*a* may be circumferentially formed between neighboring two of the arcuate bumps 111 in the first and second groups.

Figure 7G:
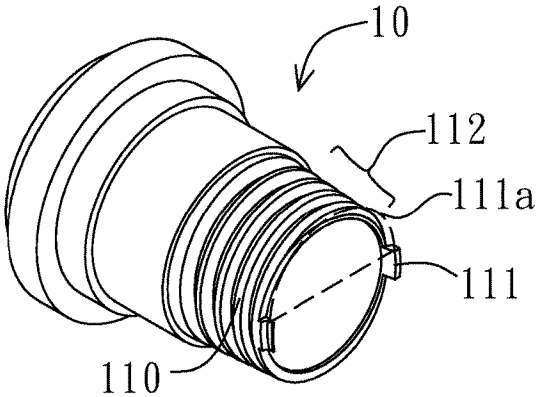

Referring to FIG. 7*g*, the rear-extension portion 110 of inner sleeve 10 may have two arcuate bumps 111 axially protruding from a rear end thereof, wherein each of the arcuate bumps 111 may have a radian between 20 and 50 degrees or between 30 and 80 degrees with respect to the axis of the inner sleeve 10.

Each of the cuts 111*a* as illustrated in FIGS. 7*a*-7*g* may have an axially depth that may be between 0.5% and 2%, between 2% and 5%, between 5% and 10% or between 11% and 15% of an axial distance of the inner sleeve 10.

In accordance with the present application, the connector is provided with the inner sleeve 10 or 20 having the relatively short rear-extension portion 110 or 210 and thus the coaxial cable having the plastic jacket 9 made of a fire-resistance or heat-resistance material may be easily mounted to the connector. Further, the inner sleeve 10 or 20 is provided with the threaded surface 112 or 212 to engage with the coaxial cable, and thus a bonding strength between the connector and coaxial cable may be enhanced.

The scope of protection is limited solely by the claims, and such scope is intended and should be interpreted to be as broad as is consistent with the ordinary meaning of the language that is used in the claims when interpreted in light of this specification and the prosecution history that follows, and to encompass all structural and functional equivalents thereof.

What is claimed is:

1. A connector for a coaxial cable, configured to be mounted to a first threaded surface of a connecting head of an electronic device, comprising:

a nut configured to be mounted to said first threaded surface;

an inner sleeve coaxially arranged with said nut, wherein said inner sleeve has a second threaded surface configured to be mounted to said coaxial cable; and an outer sleeve coaxially arranged with said nut and sleeved over said inner sleeve, wherein said inner sleeve has a first rear-extension portion in an inner space in said outer sleeve, wherein an annular space is between said first rear-extension portion and said outer sleeve and has an axial length smaller than an axial distance between a rear end of said inner sleeve and a rear end of said inner space.

2. The connector of claim 1, wherein said second thread surface is on an inner surface of a cylindrical wall of said inner sleeve.

3. The connector of claim 1, wherein said second thread surface is on an outer surface of a cylindrical wall of said inner sleeve at said rear-extension portion thereof and faces said annular space.

4. The connector of claim 1, wherein an outer surface of a cylindrical wall of said inner sleeve arranged at said rear-extension portion thereof and arranged to face said annular space has an angle between 3 and 10 degrees to an axial direction of said connector.

5. The connector of claim 1, wherein an inner surface of a cylindrical wall of said inner sleeve arranged at said rear-extension portion thereof has an angle between 3 and 10 degrees to an axial direction of said connector.

6. The connector of claim 1 further comprising a sheet arranged in said inner space and vertical to an axial direction of said connector, wherein said sheet has an annular portion mounted to an inner surface of a cylindrical wall of said outer sleeve, multiple longitudinal portions each having an outer end joining said annular portion and extending in a radial direction and a plate portion joining multiple inner ends of said radially-extension portions.

7. The connector of claim 1, wherein said outer sleeve comprises an inner flange tightly and radially fitted to an outer surface of a cylindrical wall of said inner sleeve, wherein said second threaded surface is distributed on an inner wall of said cylindrical wall and radially aligned with the position where said inner flange tightly and radially fitted to said outer surface.

8. The connector of claim 1, wherein said outer sleeve comprises an inner flange tightly and radially fitted to an outer surface of a cylindrical wall of said inner sleeve, wherein said first rear-extension portion has a first axial distance from the position of said inner sleeve where said inner flange tightly and radially fitted to said outer surface to a rear end of said inner sleeve, wherein said outer sleeve has a second rear-extension portion having a second axial distance from said inner flange thereof to a rear end thereof, wherein said first axial distance is smaller than 0.6 times said second axial distance.

9. The connector of claim 1, wherein said first rear-extension portion comprises a bump axially protruding rearwards from said first rear-extension portion, wherein said bump has a radian between 90 and 270 degrees with respect to an axis of said inner sleeve.

10. The connector of claim 1, wherein said first rear-extension portion comprises a first bump axially protruding rearwards from said first rear-extension portion and a second bump axially protruding rearwards from said first rear-extension portion, wherein a cut is circumferentially between said first and second bumps.

11. The connector of claim 1 further comprising a guide element having a cylinder and a flange radially and outwardly protruding from said cylinder, wherein said cylinder has a front portion in said inner sleeve and said flange contacting a rear end of said first rear-extension portion, wherein a hole axially extends in said cylinder.

12. The connector of claim 1, wherein said first rear-extension portion comprises a first bump axially protruding rearwards from said first rear-extension portion and a second bump axially protruding rearwards from said first rear-extension portion, wherein said first bump has a first radian with respect to an axis of said inner sleeve, which is substantially equal to a second radian of said second bump with respect to said axis of said inner sleeve.

13. The connector of claim 12, wherein said first radian is between 15 and 60 degrees.

14. A connector for a coaxial cable, configured to be mounted to a first threaded surface of a connecting head of an electronic device, comprising:

a nut configured to be mounted to said first threaded surface;

an inner sleeve coaxially arranged with said nut, wherein said inner sleeve has a second threaded surface configured to be mounted to said coaxial cable, wherein said second threaded surface is on an inner surface of a cylindrical wall of said inner sleeve; and an outer sleeve coaxially arranged with said nut and sleeved over said inner sleeve, wherein said inner sleeve has a first rear-extension portion in an inner space in said outer sleeve, wherein a first annular space is between said first rear-extension portion and said outer sleeve.

15. The connector of claim 14, wherein said cylindrical wall arranged at said rear-extension portion has an outer surface facing said first annular space and having an angle between 3 and 10 degrees to an axial direction of said connector.

16. The connector of claim 14, wherein said inner surface arranged at said rear-extension portion has an angle between 3 and 10 degrees to an axial direction of said connector.

17. The connector of claim 14 further comprising a sheet arranged in said inner space and vertical to an axial direction of said connector, wherein said sheet has an annular portion mounted to an inner surface of a cylindrical wall of said outer sleeve and multiple longitudinal portions each extending from said annular portion, wherein said annular portion and said longitudinal portions are configured to be arranged in a second annular space between said coaxial cable and said outer sleeve.

18. The connector of claim 14, wherein said outer sleeve comprises an inner flange tightly and radially fitted to an outer surface of said cylindrical wall, wherein said first rear-extension portion has a first axial distance from the position of said inner sleeve where said inner flange tightly and radially fitted to said outer surface to a rear end of said inner sleeve, wherein said outer sleeve has a second rear-extension portion having a second axial distance from said inner flange thereof to a rear end thereof, wherein said first axial distance is smaller than 0.6 times said second axial distance.

19. The connector of claim 14, wherein said first rear-extension portion comprises a first bump axially protruding rearwards from said first rear-extension portion and a second bump axially protruding rearwards from said first rear-extension portion, wherein said first bump has a first radian with respect to an axis of said inner sleeve, which is substantially equal to a second radian of said second bump with respect to said axis of said inner sleeve.

20. The connector of claim 14, wherein said first rear-extension portion comprises a first bump axially protruding rearwards from said first rear-extension portion and a second bump axially protruding rearwards from said first rear-extension portion, wherein a cut is circumferentially between said first and second bumps.

* * * * *